US011367408B2

(12) United States Patent
Fujikawa

(10) Patent No.: US 11,367,408 B2
(45) Date of Patent: Jun. 21, 2022

(54) ELECTRO-OPTICAL DEVICE AND ELECTRONIC APPARATUS HAVING TWO LOGICAL OPERATION CIRCUITS

(71) Applicant: SEIKO EPSON CORPORATION, Tokyo (JP)

(72) Inventor: Shinsuke Fujikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/094,454

(22) Filed: Nov. 10, 2020

(65) Prior Publication Data

US 2021/0142756 A1 May 13, 2021

(30) Foreign Application Priority Data

Nov. 11, 2019 (JP) ..... JP2019-203688

(51) Int. Cl.
*G09G 3/36* (2006.01)

(52) U.S. Cl.
CPC ..... *G09G 3/3688* (2013.01); *G09G 3/3677* (2013.01); *G09G 2310/0289* (2013.01); *G09G 2310/08* (2013.01)

(58) Field of Classification Search
CPC ..... G09G 3/36; G09G 3/3611; G09G 3/3622; G09G 3/3625; G09G 3/3677; G09G 3/3681; G09G 3/3685; G09G 2310/0289; G09G 2310/0294
USPC ..... 345/87–104
See application file for complete search history.

(56) References Cited

U.S. PATENT DOCUMENTS 5,818,412 A * 10/1998 Maekawa ..... G09G 3/3688 345/100
6,288,699 B1 9/2001 Kubota et al.
6,670,944 B1 * 12/2003 Ishii ..... G09G 3/3688 345/100
10,847,114 B2 * 11/2020 Fujikawa ..... G09G 3/3688
11,170,676 B2 * 11/2021 Fujikawa ..... G09G 3/006
2002/0070750 A1 * 6/2002 Fujita ..... G09G 3/006 324/760.02

(Continued)

FOREIGN PATENT DOCUMENTS

JP 2000-029419 A 1/2000
JP 2000-029420 A 1/2000

(Continued)

*Primary Examiner* — Alexander Eisen
*Assistant Examiner* — Nelson Lam
(74) *Attorney, Agent, or Firm* — Oliff PLC

(57) ABSTRACT

An electro-optical device includes a first switch provided between an input node supplied with a data signal and a first data line, the first switch being configured to be turned ON or OFF by a first control signal, a second switch provided between the input node and a second data line, the second switch being configured to be turned ON or OFF by the second control signal, a sequential output circuit configured to output a first pulse, and a second pulse exclusive of the first pulse, logical operational first logical operation circuit configured to acquire a first logical product signal of the first control signal and the first pulse, and a second logical product signal of the second control signal and the second pulse, and a second logical operation circuit configured to generate a logical sum signal of the first logical product signal and the second logical product signal.

7 Claims, 17 Drawing Sheets

(56) References Cited

U.S. PATENT DOCUMENTS

| | | | | |
|---|---|---|---|---|
| 2002/0196240 | A1* | 12/2002 | Hajime | G09G 3/3648 345/204 |
| 2004/0104881 | A1* | 6/2004 | Furuya | G09G 3/3677 345/98 |
| 2006/0007208 | A1* | 1/2006 | Aoki | G09G 3/2092 345/204 |
| 2006/0279313 | A1 | 12/2006 | Fujita et al. | |
| 2007/0200810 | A1* | 8/2007 | Kawata | G09G 3/3611 345/89 |
| 2008/0278468 | A1* | 11/2008 | Hosaka | G09G 3/2029 345/205 |
| 2009/0033687 | A1* | 2/2009 | Kasai | G09G 3/3291 345/690 |

FOREIGN PATENT DOCUMENTS

| | | | |
|---|---|---|---|
| JP | 2004-094271 | A | 3/2004 |
| JP | 2006-163223 | A | 6/2006 |
| JP | 2006-323267 | A | 11/2006 |
| JP | 2009-075507 | A | 4/2009 |
| JP | 2010-139535 | A | 6/2010 |
| JP | 4600147 | B2 | 12/2010 |

* cited by examiner

ELECTRO-OPTICAL DEVICE AND ELECTRONIC APPARATUS HAVING TWO LOGICAL OPERATION CIRCUITS

The present application is based on, and claims priority from JP Application Serial Number 2019-203688, filed Nov. 11, 2019, the disclosure of which is hereby incorporated by reference herein in its entirety.

BACKGROUND

1. Technical Field

The present disclosure relates to an electro-optical device and an electronic apparatus.

2. Related Art

An electro-optical device, which uses a liquid crystal element or the like as a display element, is provided with a pixel circuit corresponding to an intersection between a scanning line and a data line. The pixel circuit, when the scanning line corresponding to the pixel circuit is selected, has a brightness corresponding to a voltage of a data signal being supplied to the data line corresponding to the pixel circuit. In the electro-optical device thus configured, a demultiplexer system has been suggested as a configuration in which data signals are supplied to all of the data lines in a horizontal scanning period in which a one piece of scanning line is selected (for example, see JP 2006-323267 A).

In the demultiplexer system, the data lines are grouped for respective k pieces of data lines (k is an integer of 2 or greater), where in the horizontal scanning period, the data line is selected one by one from the data lines from a first sequence to a k-th sequence in each of the groups and the selected data line is supplied with a data signal from an input node corresponding to the group.

Note that in the demultiplexer system, in each of the groups, respective k pieces of switches are provided between the input node and the k pieces of data lines, where the k pieces of switches are sequentially and exclusively switched in the horizontal scanning period, to supply the data signal from the input node to the data line being selected.

However, in the electro-optical device, there is a strong demand for higher definition. In order to satisfy the demand for higher definition, the number of the data lines needs to be increased. The increase in the number of the data lines in the demultiplexer system can be addressed by increasing the "k" of the number of the data lines constituting the group. In order to prevent, when the k is increased, a reduction in a selection period per one piece of the data line in the horizontal scanning period, it is conceivable to narrow a period between a period for causing a switch to turn ON and a period for causing the next switch to turn ON, that is, a period for causing the two switches to turn OFF.

The electro-optical device is provided with an inspection circuit to adjust a timing for causing each of the switches of the demultiplexer to turn ON, for example. Unfortunately, in the demultiplexer system, narrowing a period for causing the two switches described above to turn OFF makes it difficult to monitor an output signal from the inspection circuit.

SUMMARY

In order to resolve the above-described issue, an electro-optical device according to an aspect of the present disclosure includes a first switch provided between an input node supplied with a data signal and a first data line, the first switch being configured to be turned ON or OFF by a first control signal, a second switch provided between the input node and a second data line, the second switch being configured to be turned ON or OFF by the second control signal, a sequential output circuit configured to output a first pulse, and a second pulse exclusive of the first pulse, logical operational first logical operation circuit configured to acquire a first logical product signal of the first control signal and the first pulse, and a second logical product signal of the second control signal and the second pulse, and a second logical operation circuit configured to generate a logical sum signal of the first logical product signal and the second logical product signal.

Further, an electronic apparatus according to an aspect of the present disclosure includes the electro-optical device described above.

DESCRIPTION OF EXEMPLARY EMBODIMENTS

Hereinafter, electro-optical devices according to embodiments will be described with reference to the accompanying drawings. Note that in each of the drawings, a size and a scale of each of components are made different as appropriate from the actual size and the actual scale of each of the components. Also, the embodiments described below are suitable specific examples of the present disclosure, and to which various technically preferred limitations are appended, however, the scope of the present disclosure is not limited to these embodiments unless otherwise specifically described in the following descriptions to limit the present disclosure.

Figure 1:
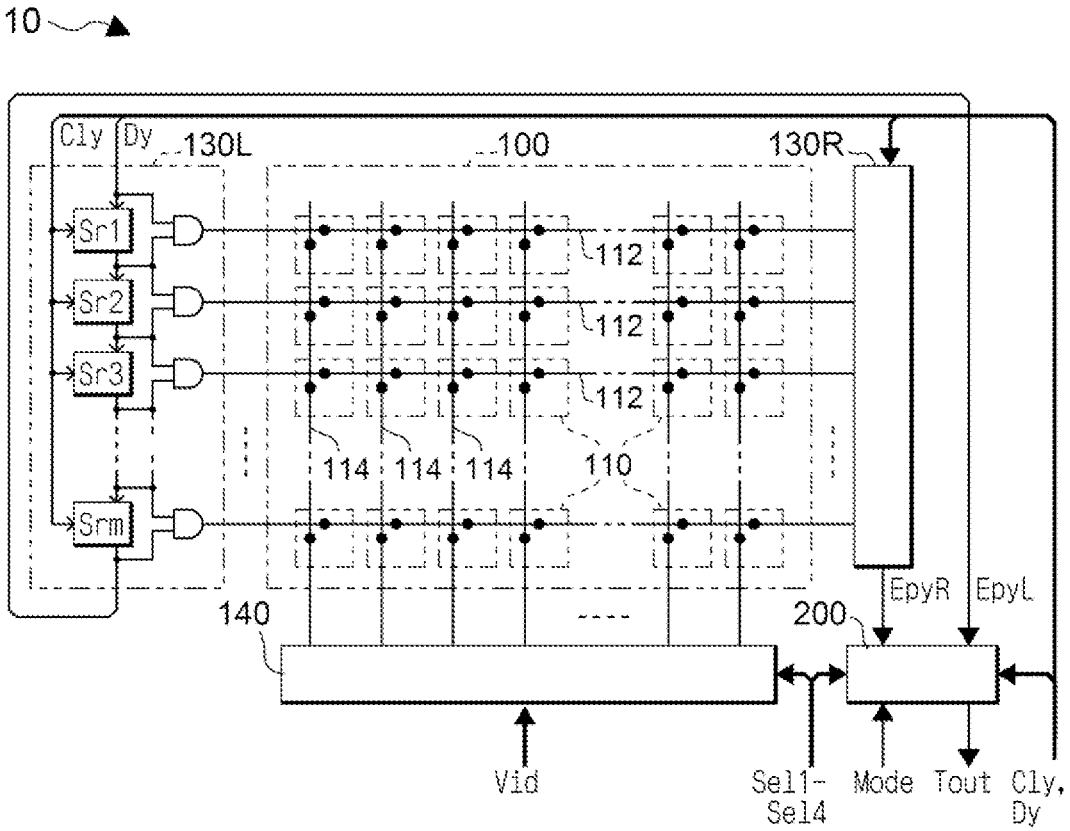
FIG. 1 is a block diagram illustrating a configuration of an electro-optical device according to a first embodiment.
Figure 2:
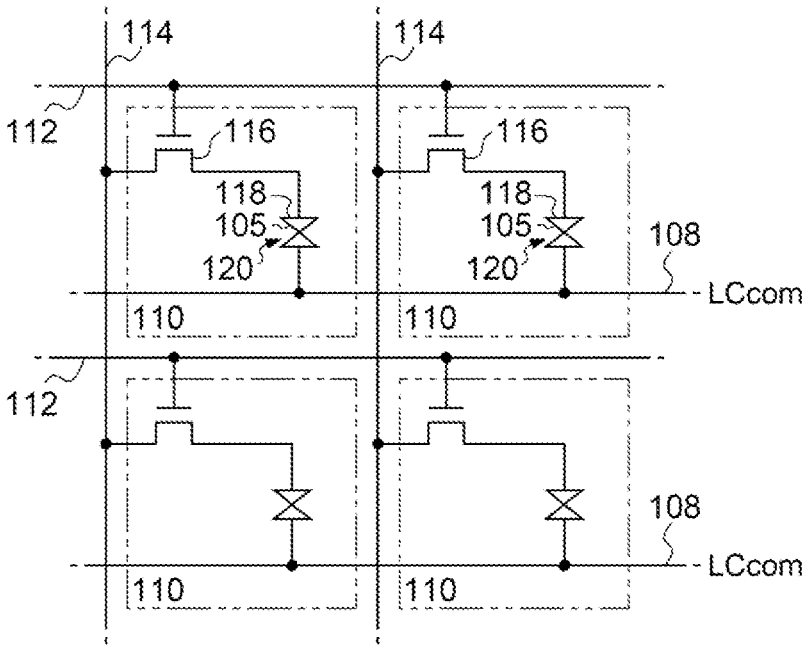
FIG. 2 is a diagram illustrating an equivalent circuit of a pixel circuit of an electro-optical device.
Figure 3:
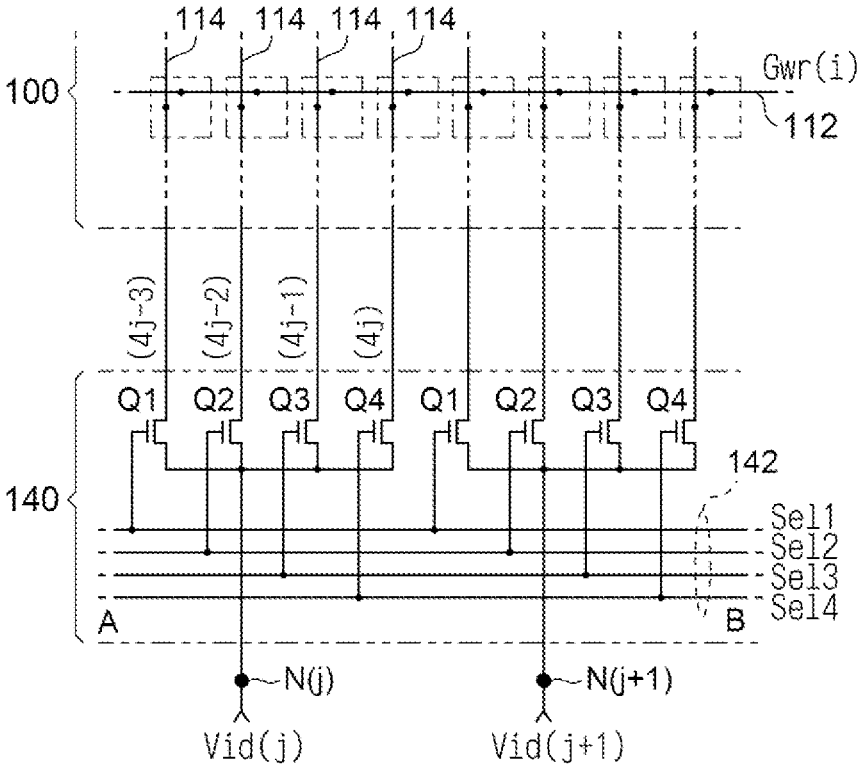
FIG. 3 is a diagram illustrating a configuration of a demultiplexer of an electro-optical device.

FIG. 1 is a block diagram illustrating a configuration of an electro-optical device 10 according to a first embodiment, FIG. 2 is a diagram illustrating an equivalent circuit of a pixel circuit 110 of the electro-optical device 10, and FIG. 3 is a circuit diagram illustrating a demultiplexer 140 and the like of the electro-optical device 10.

The electro-optical device 10 serves as a transmissive liquid crystal panel used as a light valve of a liquid crystal projector, for example. As illustrated in FIG. 1, the electro-optical device 10 includes a display region 100, scanning line drive circuits 130L and 130R, the demultiplexer 140, and an inspection circuit 200.

In the display region 100, the pixel circuits 110 corresponding to pixels of an image to be displayed are arrayed in a matrix pattern. Specifically, in the display region 100, m pieces of scanning lines 112 are provided extending in a lateral direction in the figures, where n pieces of data lines 114 extend in a vertical direction in the figures, and are provided in a manner electrically insulated with respect to the scanning lines 112.

Further, the pixel circuits 110 are provided corresponding to the intersections between the m pieces of scanning lines 112 and the n pieces of data lines 114. Thus, in the first embodiment, the pixel circuits 110 are arrayed in a matrix pattern having m vertical columns and n horizontal rows.

Here, the m is an integer of 2 or greater, and the n is an integer of 2 or greater, which are multiple of 4 in the first embodiment.

In the matrix pattern of the scanning lines 112 and the pixel circuits 110, in order to distinguish the columns from one another, the columns may be referred to as 1, 2, 3, . . . , (m−1), and m columns in the order from the top in the figure. Also, when a description is given without specifying the columns, i may be used to refer to as i column. Note that the i is an integer that satisfies $1 \leq i \leq m$.

Similarly, in the matrix pattern of the data lines 14 and the pixel circuits 110, in order to distinguish the rows from one another, the rows may be referred to as 1, 2, 3, . . . , (n−1), and n rows in the order from the left in the figure. Further, as described below, in the first embodiment, the data lines 114 are grouped for respective four pieces of the data lines 114, and thus four rows belonging to a j-th group may be referred to as (4j−3), (4j−2), (4j−1), and (4j)-th rows. Note that the j is an integer that satisfies $1 \leq j \leq (n/4)$.

Here, for convenience of explanation, a configuration of the pixel circuit 110 will be described.

FIG. 2 is a diagram illustrating an equivalent circuit of four pieces of the pixel circuits 110 corresponding to intersections between respective two adjacent scanning lines 112 and respective two adjacent data 114.

As illustrated in the figure, the pixel circuit 110 includes a transistor 116 and a liquid crystal element 120. The transistor 116 serves as an n-channel type thin film transistor, for example. In the pixel circuit 110, a gate node of the transistor 116 is coupled to the scanning line 112, while the source node is coupled to the data line 114 and the drain node is coupled to a pixel electrode 118.

A common electrode 108 is provided in common to all of the pixels in a manner facing the pixel electrode 118, and to which a voltage LCcom that is substantially constant in time is applied. Further, a liquid crystal 105 is interposed between the pixel electrode 118 and the common electrode 108. Thus, the liquid crystal element 120 is constituted by the pixel electrode 118, the common electrode 108, and the liquid crystal 105 for each of the pixel circuits 110. Note that in the pixel circuit 110, a storage capacitor, the illustration of which is omitted, is provided in parallel to the liquid crystal element 120.

Referring back to FIG. 1, a description will be given. The scanning line drive circuit 130L is provided at the left of the display region 100 in the figure. The scanning line drive circuit 130L includes m sets of AND circuits and delay circuits that are one-to-one corresponding to the m pieces of scanning lines 112. Among these components, m pieces of delay circuits Sr1 to Srm are cascaded in series. The term cascaded refers to a serial coupling in which an output signal from a delay circuit in a stage also serves as an input signal to a delay circuit in the next stage. The delay circuits Sr1 to Srm are each configured to output pulse signals, which are input to these delay circuits, in synchronization with a clock signal Cly and a clock signal/Cly having a logically inverted relationship with the clock signal Cly, by delaying as much as a half period of the clock signal Cly.

Note that in FIG. 1, the clock signal/Cly is omitted in order to avoid complications. Also, a start pulse Dy is input to the delay circuit Sr1 in the first stage, which is the initial stage, and an end pulse EpyL is output from the delay circuit Srm in the m-th stage, which is the final stage. Further, the start pulse Dy and the clock signal Cly are supplied from a display control circuit, the illustration of which is omitted, and the end pulse EpyL is supplied to the inspection circuit 200.

A one AND circuit is configured to output a logical product signal of an input signal to a delay circuit corresponding to the AND circuit and an output signal from the delay circuit, and to output the logical product signal as a scanning signal to the scanning line 112 corresponding to the AND circuit. Note that an output control signal for controlling an output signal from the AND circuit may be provided, and a logical product signal of the output signal from the AND circuit and the output control signal may be used as the scanning signal. The output control signal may also be referred to as enable signal.

The scanning line drive circuit 130R has the same configuration as in the scanning line drive circuit 130L except that the scanning line drive circuit 130R is provided at the right of the display region 100 in the figure. That is, the scanning line drive circuit 130R is configured to be input with the start pulse Dy and the clock signal, and to output the scanning signal and the end pulse as in the scanning line drive circuit 130L. Note that, in order to distinguish from the end pulse EpyL by the scanning line drive circuit 130L, the reference sign of the end pulse output from the scanning line drive circuit 130R is denoted as EpyR.

The configuration is employed in which the scanning signal is supplied, by the scanning line drive circuits 130L and 130R, from both of the left and right of the display region 100 to the scanning line 112, in order to minimize an influence due to the delay compared to a configuration in which the scanning signal is supplied from one of the left or right of the display region 100.

As described above, the data lines 114 are grouped for the respective four pieces of the data lines 114, and thus, as for the j-th group, the following four pieces of the data lines 114 belong to this j-th group. Specifically, to the j-th group, the data lines 114 in (4j−3), (4j−2), (4j−1), and (4j)-th rows belong.

Note that as for the data lines 114, in order to describe operations in the group, the (4j−3)-th row is described as first sequence, the (4j−2)-th row is described as second sequence, the (4j−1)-th row is described as third sequence, and the (4j)-th row is described as fourth sequence.

The demultiplexer 140 includes transistors that are one-to-one corresponding to the data lines 114, as illustrated in FIG. 3.

Specifically, the demultiplexer 140 include transistors Q1 to Q4 for each of the groups, where among these transistors, the transistor Q1 is provided corresponding to the data line 114 of the first sequence, the transistor Q2 is provided corresponding to the data line 114 of the second first sequence, the transistor Q3 is provided corresponding to the data line 114 of the third first sequence, and the transistor Q4 is provided corresponding to the data line 114 of the fourth sequence.

In the j-th group, a source node of the transistor Q1, a source node of the transistor Q2, a source node of the transistor Q3, and a source node of the transistor Q4 are commonly coupled to an input node N(j).

In the j-th group, a drain node of the transistor Q1 is coupled to the data line 114 in the (4j−3)-th row, and a gate node of the transistor Q1 is supplied with a control signal Sel1. A drain node of the transistor Q2 is coupled to the data line 114 in the (4j−2)-th row, and a gate node of the transistor Q2 is supplied with a control signal Sel2. A drain node of the transistor Q3 is coupled to the data line 114 in the (4j−1)-th row, and a gate node of the transistor Q3 is supplied with a control signal Sel3. A drain node of the transistor Q4 is coupled to the data line 114 in the (4j)-th row, and a gate node of the transistor Q4 is supplied with a control signal Sel4.

Note that, to the input node N(j), respective data signals for four pixels located at intersections between columns selected by the scanning line drive circuits 130L and 130R, and the (4j−3), (4j−2), (4j−1), and (4j)-th rows in the j-th group are supplied in a time divisional manner from the display control circuit described above in synchronization with the supply of the control signals Sel1 to Sel4, as described below.

The transistors Q1 to Q4 in another group other than the j-th group are also coupled in the same manner as in the j-th group.

Note that, in a (j+1)-th group as well, the source node of the transistor Q1, the source node of the transistor Q2, the source node of the transistor Q3, and the source node of the transistor Q4 are commonly coupled to an input node N(j+1).

As such, the input nodes are provided corresponding to the groups. Accordingly, in an actual situation, there are (n/4) pieces of the input nodes, which are consisting of from N(1) to N(n/4). To each of the input nodes, the data signal is supplied in a time divisional manner, as described below. In FIG. 1, for convenience of explanation, these data signals are generically denoted as Vid.

In addition, the control signals Sel1 to Sel4 are supplied from the display control circuit described above via four pieces of signal lines 142.

Here, the four pieces of signal lines 142 are provided extending in the same direction as the direction in which the data line 114 extends. Note that in the first embodiment, the control signals Sel1 to Sel4 are supplied with B side being located upstream and A side being located downstream, where the A and B sides are located in the extending direction in which the four pieces of signal lines 142 extend. That is, the display control circuit described above is coupled to the B side of the four pieces of signal lines 142, where the control signals Sel1 to Sel4 are supplied from the B side toward the A side.

In FIG. 1, the inspection circuit 200 is configured to be input with the end pulses EpyL and EpyR, the clock signal Cly, the control signals Sel1 to Sel4, and a signal Mode, and to output a signal Tout indicating inspection results of the scanning line drive circuits 130L and 130R and the demultiplexer 140. Note that details of the inspection circuit 200 will be described after a display operation that is premised.

Then, the display operation of the electro-optical device 10 will be described with reference to FIG. 4.

Figure 4:
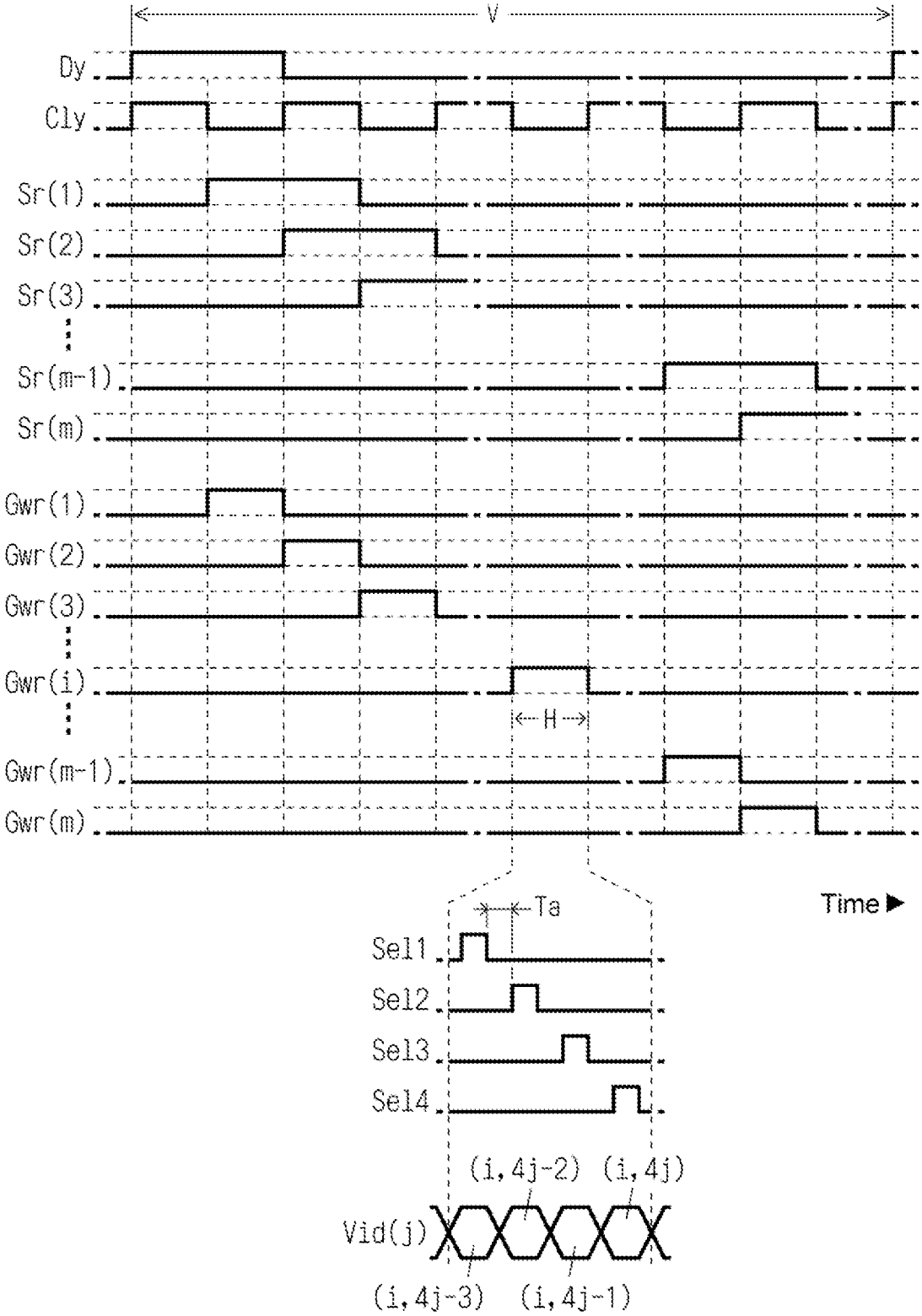
FIG. 4 is an explanatory chart illustrating a display operation of an electro-optical device.

Note that in FIG. 4, an Sr(1) indicates a signal that is output from the delay circuit Sr1 in the first stage, and thereafter similarly, Sr(2), Sr(3), . . . , and Sr(m) indicate signals that are output from the delay circuits Sr2, Sr2, Sr3, . . . , and Srm. Also, a Gwr(1) indicates a scanning signal that is supplied to the scanning line 112 in the first column, and thereafter similarly, Gwr(2), Gwr(3), . . . , and Gwr(m) indicate scanning signals supplied to the scanning lines 112 in 2, 3, . . . , and m-th columns. The Gwr(i) indicates a scanning signal supplied to the scanning line 112 in the i-th column.

When the start pulse Dy having a period length of one period of the clock signal Cly is supplied at a start timing of a vertical scanning period (V), the start pulse Dy is sequentially delayed stepwise by the half period of the clock signal Cly by the delay circuits Sr1 to Srm to be output as signals Sr(1) to Sr(m).

A logical product signal of the start pulse Dy and the signal Sr(1) is generated by the AND circuit in the first stage, and the logical product signal is output as a scanning signal Grw(1). A logical product signal of the signal Sr(1) and the signal Sr(2) is generated by the AND circuit in the second stage, and the logical product signal is output as a scanning signal Grw(2). Hereinafter similarly, a logical product signal of the signal Sr(m−1) and the signal Sr(m) is generated by the AND circuit in the m-th stage, and the logical product signal is output as a scanning signal Grw(m).

Note that in the figure, for convenience of explanation, a blanking period of the vertical scanning period V is reproduced in an abbreviated notation.

The scanning signals Gwr(1), Gwr(2), Gwr(3), . . . , and Gwr(m) output from the scanning line drive circuits 130L and 130R are sequentially and exclusively set to an H level at every half period of the clock signal Cly. Note that, as for the i-th column, during a period in which a scanning signal Gwr(i) is set to the H level, the data signal is written to the pixel circuit 110 in the i-th column, and thus the period in which the H level is achieved, that is, the half period of the clock signal Cly corresponds to a horizontal scanning period (H).

An operation of the demultiplexer 140 will be described taking the horizontal scanning period (H) in which the scanning signal Gwr(i) is set to the H level as an example. As illustrated in FIG. 4, in the horizontal scanning period (H), the control signals Sel1 to Sel4 are exclusively set to the H level in this order. During the period in which any one of the control signals Sel1 to Sel4 is set to the H level, a period Ta in which the control signals Sel1 to Sel4 are all set to an L level intervenes.

During the horizontal scanning period (H) in which the scanning signal Gwr(i) is set to the H level, the transistor Q1 of the first sequence turns ON in the demultiplexer 140 when the control signal Sel1 is set to the H level. In addition, during the period in which the control signal Sel1 is set to the H level, as for the j-th group, a signal having a voltage corresponding to a gray-scale level of the pixel at the i-th column and (4j−3)-th row is supplied, as a data signal Vid(j), from the display control circuit described above to the input node N(j). Accordingly, to the data line 114 in the (4j−3)-th row, the data signal Vid(j) is supplied.

When the control signal Sel1 is set to the L level, the transistor Q1 turns OFF.

Subsequently, when the control signal Sel2 is set to the H level, the transistor Q2 of the second sequence turns ON. During the period in which the control signal Sel2 is set to the H level, as for the j-th group, a signal having a voltage corresponding to a gray-scale level of the pixel at the i-th column and (4j−2)-th row is supplied as the data signal Vid(j) to the input node N(j). Accordingly, to the data line 114 in the (4j−2)-th row, the data signal Vid(j) is supplied.

Hereinafter similarly, when the control signal Sel3 is set to the H level, the transistor Q3 of the third sequence turns ON, and the data signal Vid(j) having a voltage corresponding to a gray-scale level of the pixel at the i-th column and (4j−1)-th row is supplied to the data line 114 in the (4j−1)-th row, and subsequently, when the control signal Sel4 is set to the H level, the transistor Q4 in the fourth sequence turns ON, and the data signal Vid(j) having a voltage corresponding to a gray-scale level of the pixel at the i-th column and (4j)-th row is supplied to the data line 114 in the (4j)-th row.

Note that a distribution operation that the data signal is supplied to the data line 114 thus configured is performed in a similar manner for the groups other than the j-th group. Accordingly, to the data lines 114 from the first row to the m-th row, respective data signals having voltages corresponding to gray-scale levels of the pixels from the i-th column and first row to the i-th column and m-th row are supplied in this order.

Incidentally, in the horizontal scanning period (H) in which the scanning line 112 in the i-th column is selected, the scanning signal Gwr(i) is set to the H level, and thus the transistor 116 turns ON at n pieces of the pixel circuits 110 provided corresponding to the i-th column. The data line 114 and the pixel electrode 118 become an electrically coupled state due to the turning ON of the transistor 116, and thus the data signal supplied to the data line 114 reaches the pixel electrode 118 via the transistor 116 that turns ON. When the scanning line 112 is set to the L level, the transistor 116 turns OFF, and a voltage of the data signal having reached the pixel electrode 118 is held by the capacitive properties of the liquid crystal element 120.

As well known, in the liquid crystal element 120, an alignment state of the liquid crystal 105 varies depending on an electrical field generated by the pixel electrode 118 and the common electrode 108. Thus, the liquid crystal element 120 has a transmittance according to an effective value of an applied voltage. That is, in the electro-optical device 10, the transmittance varies for each of the liquid crystal elements 120 of the pixel circuits 110.

Note that a voltage holding operation on the liquid crystal element 120 thus configured is performed for each of the n pieces of the pixel circuits 110 provided corresponding to the i-th column. Moreover, such a voltage holding operation is performed in the order of 1, 2, 3, . . . , and m-th columns, a voltage corresponding to the data signal is held by each of the liquid crystal elements 120 of the pixel circuits 110 arrayed by m number in column and n number in row, to eventually cause the liquid crystal elements 120 to have an aimed transmittance.

Next, the inspection circuit 200 will be described.

Figure 5:
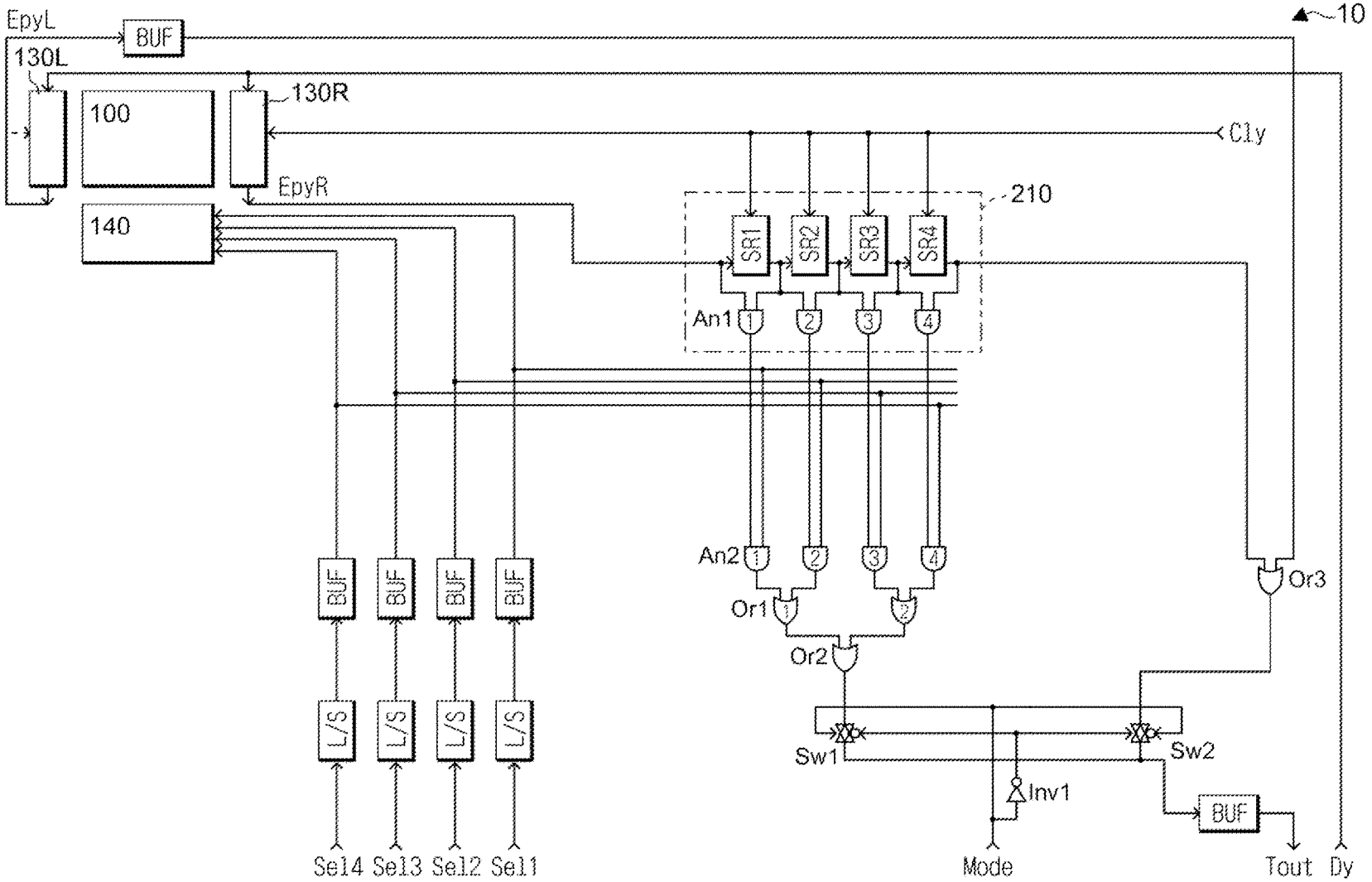
FIG. 5 is a diagram illustrating a configuration of an inspection circuit and the like of an electro-optical device.

FIG. 5 is a diagram illustrating a configuration of the inspection circuit 200 and the like. FIG. 5 additionally illustrates, in the electro-optical device 10, elements other than the inspection circuit 200, specifically, the display region 100, the scanning line drive circuits 130L and 130R, and the demultiplexer 140.

Also, in the figure, an L/S indicates a level shifter, which is configured to convert a low amplitude signal into a high amplitude signal. Specifically, the level shifter is configured to convert a logic signal of 3.3 volts, which is a potential difference between the H level and the L level, into a logic signal of 15 volts, which is the potential difference between the H level and the L level. The level shifter may be configured with a first stage where the logic signal of 3.3 volts, which is the potential difference between the H level and the L level, is converted into a logic signal of 8 volts, and a second stage where an output signal in the first stage is converted into the logic signal of 15 volts. In addition, a BUF indicates a buffer, which is a circuit that is configured to convert a high impedance signal into a low impedance signal.

The control signal Sel1 supplied from the display control circuit is converted by the level shifter into the high amplitude signal, to be then supplied via the buffer to the demultiplexer 140. Each of the control signals Sel2, Sel3, and Sel4 is also converted by the level shifter into the high amplitude signal, to be then supplied via the buffer to the demultiplexer 140.

The inspection circuit 200 includes various logical operation circuits such as an AND circuit and an OR circuit, where some of the logical operation circuits are specified by combining, via a "_" (underbar), a reference sign noted at the vicinity and a reference sign marked inside the logical operation circuit, due to limitations of space. For example, a sign of "An1" is given to collectively designate four pieces of the AND circuits, where numbers of "1" to "4" are given in this order to the insides of the four pieces of the AND circuits. Accordingly, for example, among the four pieces of the AND circuits to which the sign of "An1" is given, the inside of the leftmost AND circuit in the figure is denoted by a sign of "1", thus, the reference sign for the leftmost AND circuit is indicated by An1_1.

The inspection circuit 200 includes a sequential output circuit 210.

The end pulse EpyR output from the scanning line drive circuit 130R is input to the sequential output circuit 210. The sequential output circuit 210 is configured to delay the end pulse EpyR by two periods of the clock signal Cly, and to supply the end pulse EpyR to one of two input ends of an OR circuit Or3. Note that the end pulse EpyL output from the scanning line drive circuit 130L is supplied via the buffer to the other of the two input ends of the OR circuit Or3.

The sequential output circuit 210 includes delay circuits SR1 to SR4 and AND circuits An1_1 to An1_4. The delay circuits SR1 to SR4 correspond one-to-one to the AND circuits An1_1 to An1_4, where among these circuits, the delay circuits SR1 to Sr4 of the four stages are cascaded. The delay circuits SR1 to SR4 are each configured to output pulses, which are input to these delay circuits, in synchronization with the clock signal Cly and the clock signal/Cly described above, by delaying as much as the half period of the clock signal Cly.

Note that in FIG. 5, the clock signal/Cly is omitted. Also, the delay circuit SR1 in the first stage is configured to be input with the end pulse EpyR, and the pulse output from the delay circuit SR4 at the fourth stage is supplied to the OR circuit Or3. A one AND circuit, among the AND circuits An1_1 to An1_4, is configured to output a logical product signal of an input signal to the delay circuit corresponding to the AND circuit and an output signal from the delay circuit. For example, the AND circuit An1_2 is configured to output a logical product signal of an input signal to the delay circuit SR2 corresponding to the AND circuit An1_2 and an output signal from the delay circuit SR2.

The inspection circuit 200, in addition to the sequential output circuit 210, includes AND circuits An2_1 to An2_4, OR circuits Or1_1, Or1_2, Or2, and Or3, transfer gates Sw1 and Sw2, and a NOT circuit Inv1.

The AND circuit An2_1 is configured to output a logical product signal of the control signal Sel1 input to the demultiplexer 140 and a signal output from the AND circuit An1_1. Similarly, the AND circuit An2_2 is configured to output a logical product signal of the control signal Sel2 input to the demultiplexer 140 and a signal output from the AND circuit An1_2, the AND circuit An2_3 is configured to output a logical product signal of the control signal Sel3 input to the demultiplexer 140 and a signal output from the AND circuit An1_3, and the AND circuit An2_4 is configured to output a logical product signal of the control signal Sel4 input to the demultiplexer 140 and a signal output from the AND circuit An1_4.

The OR circuit Or1_1 is configured to output a logical sum signal of a signal output from the AND circuit An2_1 and a signal output from the AND circuit An2_2, and the OR circuit Or1_2 is configured to output a logical sum signal of a signal output from the AND circuit An2_3 and a signal output from the AND circuit An2_4.

The OR circuit Or2 is configured to output a logical sum signal of a signal output from the OR circuit Or1_1 and a signal output from the OR circuit Or1_2.

The OR circuit Or3 is configured to output a logical sum signal of the signal SR(4) output from the sequential output circuit 210 and the end pulse EpyL, which have passed through the buffer.

The transfer gates Sw1 and Sw2 are switches that are configured to be switched ON between an input end and an output end, provided that a signal at a positive control end that is not marked with a circle icon is at the H level and a signal at a negative control end marked with the circle icon is at the L level, and are configured to be switched OFF between the input end and the output end, provided that the signal at the positive control end is at the L level and the signal at the negative control end is at the H level.

The input end of the transfer gate Sw1 is configured to be input with a signal output from the OR circuit Or2, and the input end of the transfer gate Sw2 is configured to be input with a signal output from the OR circuit Or3.

The positive control end of the transfer gate Sw1 and the negative control end of the transfer gate Sw2 are supplied with the signal Mode supplied from the display control circuit described above or an adjustment device, and the negative control end of the transfer gate Sw1 and the positive control end of the transfer gate Sw2 are supplied with a signal, which is logically inverted by the NOT circuit Inv1 from the signal Mode.

Accordingly, the transfer gates Sw1 and Sw2 mutually and exclusively turns ON or OFF. Specifically, the transfer gate Sw1 turns ON and the transfer gate Sw2 turns OFF, provided that the signal Mode is at the H level. While the transfer gate Sw1 turns OFF and the transfer gate Sw2 turns ON, provided that the signal Mode is at the L level. A signal output from the transfer gate Sw1 or Sw2 passes through the buffer to be output as the signal Tout.

Further, the signal Mode is set to the L level when the scanning line drive circuits 130L and 130R are subjected to an inspection, while the signal Mode is set to the H level when the control signals Sel1 to Sel4 are monitored to adjust a timing and the like.

Figure 6:
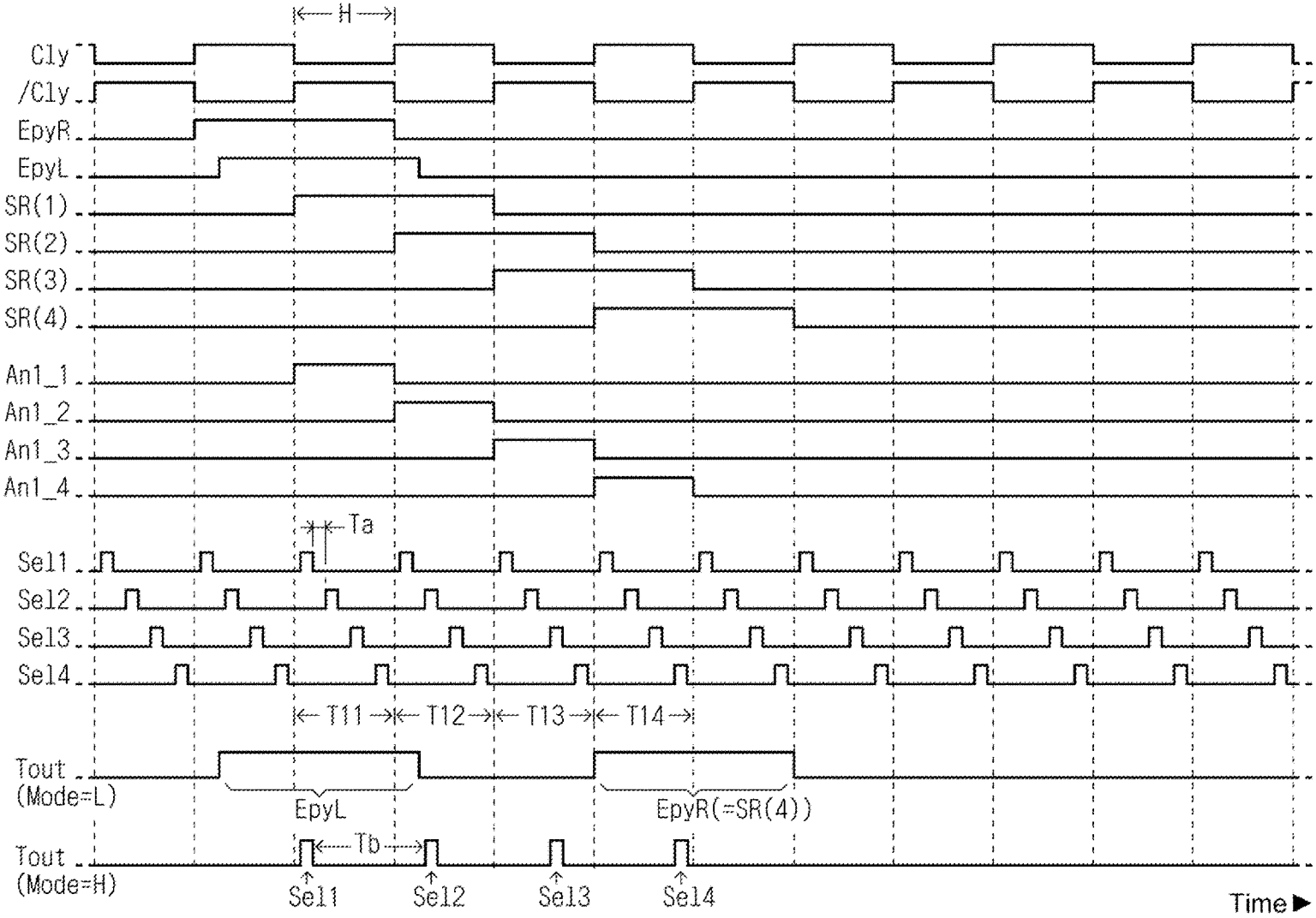
FIG. 6 is an explanatory chart illustrating an operation of an inspection circuit of a first embodiment.

An operation of the inspection circuit 200 will be described. FIG. 6 is an explanatory chart illustrating the operation of the inspection circuit 200 of the electro-optical device 10 according to the first embodiment.

First, an operation when the signal Mode is at the L level to inspect the scanning line drive circuits 130L and 130R will be described. The transfer gate Sw1 turns OFF and the transfer gate Sw2 turns ON provided that the signal Mode is at the L level, and thus the signal Tout is an output signal from the OR circuit Or3.

The start pulse Dy is delayed by (m/2) periods of the clock signal Cly by the delay circuits Sr1 to Srm of the scanning line drive circuit 130L, to be output as the end pulse EpyL. Note that the signal Sr(m) output from the delay circuit Srm in the final stage is the end pulse EpyL, where the end pulse EpyL is supplied to the other of the two input ends of the OR circuit Or3.

The start pulse Dy is also delayed by the (m/2) periods of the clock signal Cly by the delay circuits Sr1 to Srm of the scanning line drive circuit 130R, to be sequentially input, as the end pulse EpyR, to the sequential output circuit 210. Note that in FIG. 6, the end pulse EpyL is slightly delayed from the end pulse EpyR, which is due to a difference in a wiring length and an influence of the buffer.

The end pulse EpyR is delayed by the delay circuits SR1 to SR4 of the sequential output circuit 210 for the two periods of the clock signal Cly, to be supplied to one of the two input ends of the OR circuit Or3.

Accordingly, in the logical sum signal output as the signal Tout from the OR circuit Or3 when the signal Mode is at the L level, the end pulse EpyL supplied to the input end of the OR circuit Or3 without passing through the delay circuits SR1 to SR4, and the end pulse EpyR (=signal SR(4)) having been delayed by the two periods of the clock signal Cly by the delay circuits SR1 to SR4 appear without being superimposed on each other.

Thus, when the display control circuit or the adjustment device sets the signal Mode to the L level, and it can be determined that the scanning line drive circuit 130L is normal, provided that a waveform corresponding to the end pulse EpyL appears in the signal Tout at the time when the (m/2) periods of the clock signal Cly have elapsed after the supply of the start pulse Dy, and it can be determined that the scanning line drive circuit 130R (and the sequential output circuit 210) is normal, provided that a waveform corresponding to the end pulse EpyR appears in the signal Tout at a time when the two periods of the clock signal Cly have further elapsed.

Next, an operation when the signal Mode is at the H level to adjust timings of the control signals Sel1 to Sel4 will be described. The transfer gate Sw1 turns ON and the transfer gate Sw2 turns OFF provided that the signal Mode is at the H level, and thus the signal Tout is an output signal from the OR circuit Or2.

The end pulse EpyR output from the scanning line drive circuit 130R is delayed stepwise by the half period of the clock signal Cly by the delay circuits SR1 to SR4 of the sequential output circuit 210. A logical product signal of the input signal and the output signal at each of the delay circuits SR1 to SR4 is output from the AND circuits An1_1 to An1_4.

Specifically, a superimposed portion, which is at the H level, of the end pulse EpyR being an input to the delay circuit SR1 and the signal SR(1) output from the delay circuit Sr1, is output from the AND circuit An1_1. Similarly, a superimposed portion of the signal SR(1) being an input to the delay circuit SR2 and the signal SR(2) output from the delay circuit SR2 is output from the AND circuit An1_2, a superimposed portion of the signal SR(2) being an input to the delay circuit SR3 and the signal SR(3) output from the delay circuit SR3 is output from the AND circuit An1_3, and a superimposed portion of the signal SR(3) being an input to the delay circuit SR4 and the signal SR(4) output from the delay circuit SR4 is output from the AND circuit An1_4. Specifically, during the period T11, the output signal from the AND circuit An1_1 is set to the H level, and the output signals from the AND circuits An1_2, An1_3, and An1_4 are set to the L level. Similarly, in the period T12 following the period T11, the output signal from the AND circuit An1_2 is set to the H level, and the output signals from the AND circuit An1_1, An1_3, and An1_4 are set to the L level. During the period T13 following the period T12, the output signal from the AND circuit An1_3 is set to the H level, and the output signals from the AND circuits An1_1, An1_2, and An1_4 are set to the L level. In the period T14 following the period T13, the output signal from the AND circuit An1_4 is set to the H level, and the output signals from the AND circuits An1_1, An1_2, and An1_3 are set to the L level.

During the period T11, the AND circuit An2_1 is configured to output a signal reflecting a logic of the control signal Sel1 supplied to the demultiplexer 140, and the AND circuits An2_2, An2_3, and An2_4 are all configured to output the L level, irrespective of the control signals Sel2, Sel3, and Sel4.

Similarly, in the period T12, the AND circuit An2_2 is configured to output a signal reflecting a logic of the control signal Sel2 supplied to the demultiplexer 140, and the AND circuits An2_1, An2_3, and An2_4 are all configured to output the L level. During the period T13, the AND circuit An2_3 is configured to output a signal reflecting a logic of the control signal Sel3 supplied to the demultiplexer 140, and the AND circuits An2_1, An2_2, and An2_4 are all configured to output the L level. During the period T14, the AND circuit An2_4 is configured to output a signal reflecting a logic of the control signal Sel4 supplied to the demultiplexer 140, and the AND circuits An2_1, An2_2, and An2_3 are all configured to output the L level.

The output signal from the OR circuit Or2 is a logical sum signal of the AND circuit An2_1, An2_2, An2_3, and An2_4. Thus, when the signal Mode is at the L level, only a waveform reflecting the control signal Sel1 appears in the signal Tout during the period T11, only a waveform reflecting the control signal Sel2 appears during the period T12, only a waveform reflecting the control signal Sel3 appears during the period T13, and only a waveform reflecting the control signal Sel4 appears during the period T14.

It is possible to adjust the timings of the control signals Sel1 to Sel4 by monitoring a waveform, upstream of the signal, at the output end of the display control circuit or the adjustment device, for example. However, actually in the electro-optical device 10, the control signals Sel1 to Sel4 are supplied, via the level shifter, the buffer, a wiring, or the like, to the demultiplexer 140, and thus it is preferred to monitor a waveform, downstream of the signal, at the input end of the demultiplexer 140, for example.

In the first embodiment, when the display control circuit or the adjustment device sets the signal Mode to the H level, waveforms reflecting the control signals Sel1 to Sel4 having actually reached the demultiplexer 140 appear in the signal Tout in a state of being separated during the periods T11 to T14.

Accordingly, the control signals Sel1 to Sel4 having reached the demultiplexer 140 are clearly distinguished, which facilitates adjusting the timings of the control signals Sel1 to Sel4 while monitoring the control signals Sel1 to Sel4 having reached the demultiplexer 140 via the level shifter or the buffer.

To describe in detail advantageous effects of the first embodiment, it is sufficient to provide, when intending only to monitor the waveform of the input end of the demultiplexer 140, four pieces of inspection terminals for outputting the control signals Sel1 to Sel4 having reached the demultiplexer 140 in the electro-optical device 10.

However, due to a strong demand for miniaturization for the electro-optical device 10 such as that used as a light valve of a liquid crystal projector, there is a circumstance in which it is desired to avoid a configuration that consumes a limited space for the inspection terminals as much as possible. In the first embodiment, the description is given such that the number of the control signals Sel is "4", and an issue that the space is consumed for the inspection terminals becomes more significant when the number is expanded to "8", "16", . . . .

In contrast, in the first embodiment, it is sufficient to use only one inspection terminal, which is a terminal from which the signal Tout is output.

Next, when using only one inspection terminal, it is simply conceivable to employ a configuration for outputting a logical sum signal of the control signals Sel1 to Sel4 having reached the demultiplexer 140 in the electro-optical device 10. Taking this configuration into consideration as a comparative example for a purpose of explanation, where in the comparative example, it is difficult to distinguish a difference among the control signals Sel1 to Sel4 having reached the demultiplexer 140.

This point will be described with reference to FIG. 18.

Figure 18A:
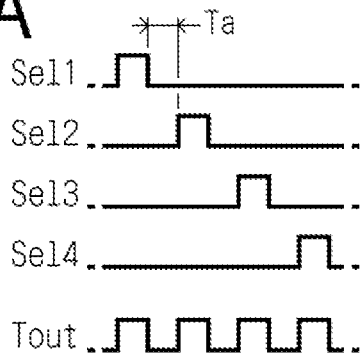
FIG. 18A-FIG. 18C is a chart illustrating an example of an output signal waveform of an inspection circuit according to a comparative example.

When the control signals Sel1 to Sel4 are illustrated in FIG. 18A and the logical sum signal of the control signals Sel1 to Sel4 are denoted as Tout as in the first embodiment, then the signal Tout will ideally be the waveform as illustrated in the figure.

Figure 18B:
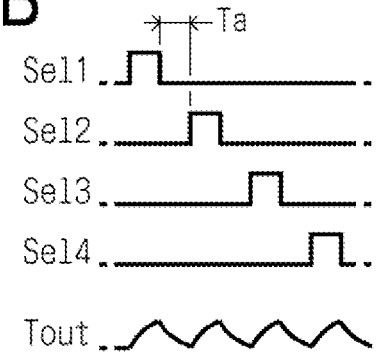

However, the waveform of the signal Tout, as influenced by a capacitor and the like that is parasitic to the interior of the electro-optical device 10, have a tendency to become dull as illustrated in FIG. 18B.

Figure 18C:
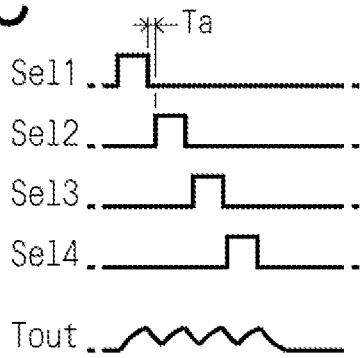

An interval Ta between respective adjacent signals among the control signals Sel1 to Sel4, that is, a period in which the control signals Sel1 to Sel4 are all at the L level is shortened for achieving high definition, for increasing the number of control signals, or for the like, it becomes difficult for the control signals Sel1 to Sel4 to detect the waveform edges due to the dull waveform of the signal Tout, as illustrated in FIG. 18C. For example, a falling end of the signal Tout in accordance with the control signal Sel1 is to be detected. In this case, a period is set to detect a time at which an output voltage of the signal Tout reaches 50% of the drive voltage, for example. However, the period may include a plurality of waveform edges, such as the falling end of the signal Tout in accordance with the control signal Sel1, a rising end of the signal Tout in accordance with the control signal Sel2, and a falling end of the signal Tout in accordance with the control signal Sel2 in case of high speed driving. This makes it impossible to identify which is the falling end of the signal Tout corresponding to the control signal Sel1.

In contrast, in the first embodiment, a logical product signal of the control signals Sel1 to Sel4 having reached the demultiplexer 140 and signals from the AND circuits An1_1 to An1_4, which are sequentially delayed stepwise by the half period of the clock signal Cly to be exclusively output, is output as the signal Tout. Accordingly, as illustrated in FIG. 6, in the signal Tout, the interval between the respective waveforms reflecting the control signals Sel1 to Sel4 expands to the period Tb that is not less than the half-period of the clock signal Cly, to facilitate the identification. Thus, in an actual drive condition, the signal Tout can be monitored to observe the waveform edges of the control signals Sel1 to Sel4. In response to the result of observation of the waveform edges, the data signal can be adjusted to an appropriate timing to be supplied, to improve the display quality. Moreover, the signal Tout is output as an effective signal only in four horizontal periods during one vertical period, to suppress the power consumption.

Note that the buffer provided in a path of the signal Tout is provided to withstand a drive load to an external device such as the display control circuit or the adjustment device, however, in the first embodiment, the interval between the respective waveforms reflecting the control signals Sel1 to Sel4 expands, thus becoming less susceptible to the waveform dullness. Accordingly, the buffer described above, which is not required to have a high capability, can be miniaturized to make the circuit size compact.

In the first embodiment, when the signal Mode is at the L level, it can be determined that the scanning line drive circuits 130L and 130R and the sequential output circuit 210 are normal, provided that the waveform corresponding to the end pulse EpyL and the waveform corresponding to the end pulse EpyR appear in the signal Tout.

In the first embodiment, only the sequential output circuit 210 can be further determined whether normal or not in such a way below, for example. When the display control circuit or the adjustment device sets the signal Mode to the H level and sets all of the control signals Sel1 to Sel4 to the H level, the sequential output circuit 210 can be determined to be normal, provided that the signal Tout is at the H level throughout the periods T11 to T14, while the sequential output circuit 210 can be determined to be abnormal, provided that the signal Tout is at the L level in any one of the periods T11 to T14.

Note that in the first embodiment, the transfer gates Sw1 and Sw2 are configured to select the output signal from the OR circuit Or2 provided that the signal Mode is at the H level, and to select the output signal from the OR circuit Or3 provided that the signal Mode is at the L level, where these selections may be interchanged. The OR circuits Or1_1 and Or11_2 may have a configuration in which the OR circuit Or2 is omitted, as a four-input OR circuit. Further, the transfer gates Sw1 and Sw2 are one example of a configuration for exclusively selecting the output signal from the OR circuit Or2 or the output signal from the OR circuit Or3. Accordingly, other configurations may be employed, which include, for example, a logical operation circuit such as a NAND circuit as in the fifth embodiment described below, as long as a configuration for exclusively selecting the output signal from the OR circuit Or2 or the output signal from the OR circuit Or3.

In the first embodiment, the scanning line drive circuits 130L and 130R have a configuration in which the start pulse Dy is input from above in FIG. 1 or FIG. 5 and is sequentially transferred downward, however, the scanning line drive circuits 130L and 130R may be configured to be switchable from a case where the start pulse Dy is input from below and is sequentially transferred upward.

In addition, the sequential output circuit 210 is configured to include the delay circuits SR1 to SR4 and the AND circuits An1_1 to An1_4 in the first embodiment, however, for example, a circuit such as a decoder may also be employed as long as being able to acquire the output waveforms from the AND circuits An1_1 to An1_4 in FIG. 6 for the end pulse EpyR.

Figure 7:
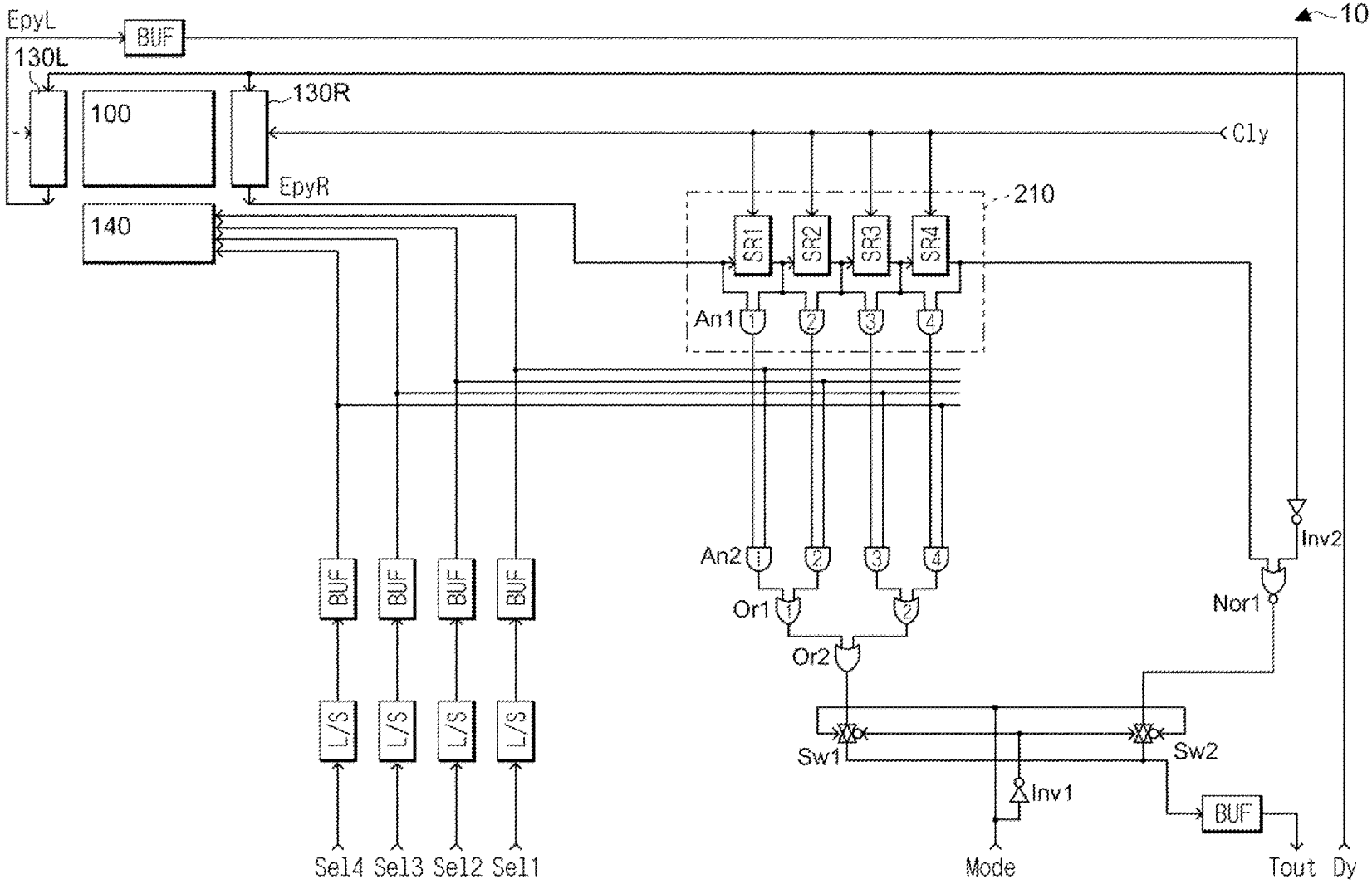
FIG. 7 is a diagram illustrating a modification example of a first embodiment.

Next, a modification example of the first embodiment will be described. FIG. 7 is a diagram illustrating a configuration of the inspection circuit 200 and the like according to a modification example of the first embodiment.

In FIG. 7, the OR circuit Or3 in FIG. 5 is replaced by a NOT circuit Inv2 and a NOR circuit Nor1. Specifically, one of two input ends of the NOR circuit Nor1 is supplied with the signal SR(4) output from the sequential output circuit 210, and the other of the two input ends of the NOR circuit Nor1 is supplied via the buffer with the end pulse EpyL output from the scanning line drive circuit 130L, which is logically inverted by the NOT circuit Inv2.

Note that in this modification example, the operation when the signal Mode is at the H level is the same operation as in the first embodiment, and thus a description will be given of a case in which the signal Mode is at the L level for the modification example.

Figure 8:
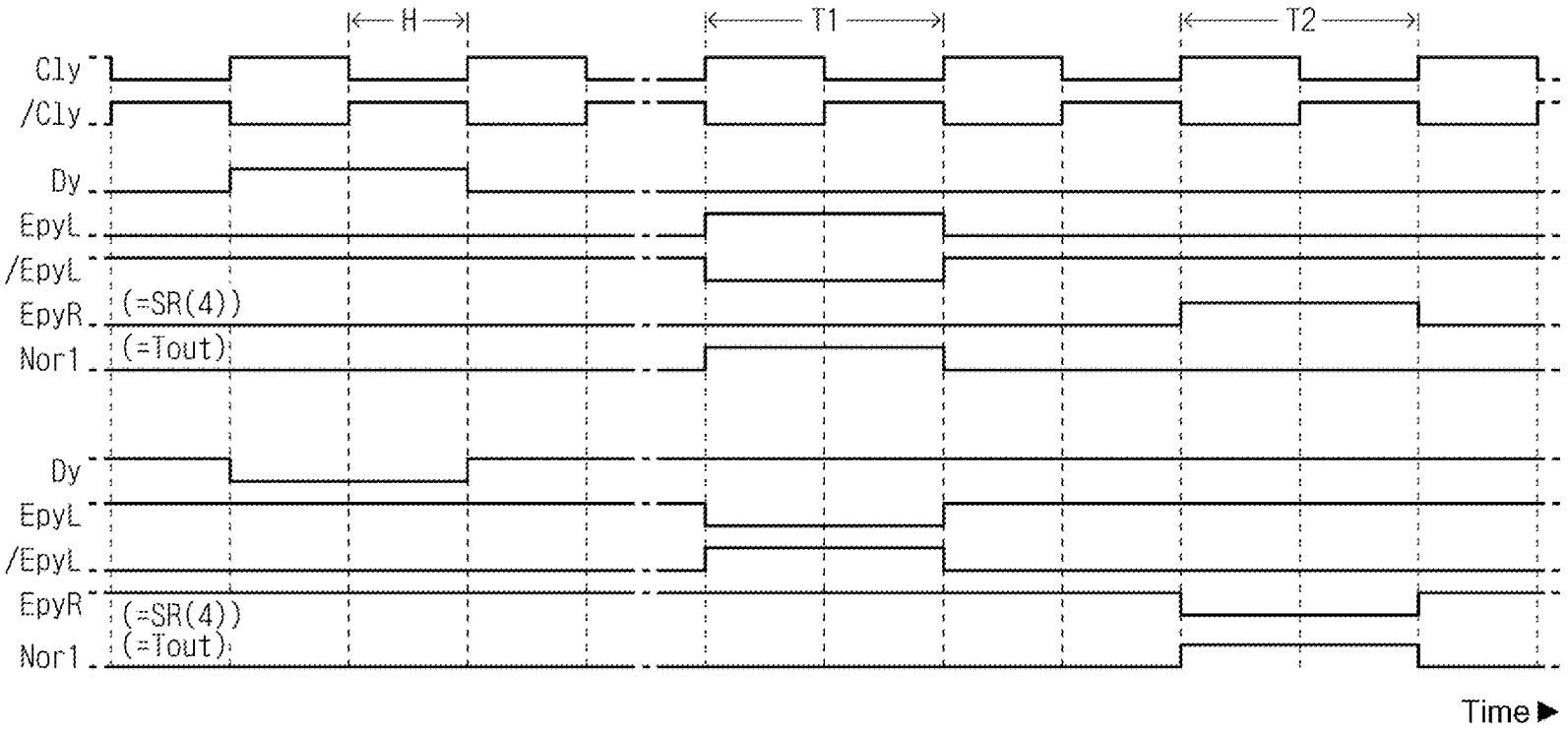
FIG. 8 is an explanatory chart illustrating an operation of an inspection circuit in a modification example of a first embodiment.

FIG. 8 is an explanatory chart illustrating an operation of the inspection circuit 200 of the electro-optical device 10 according to the modification example of the first embodiment.

When the start pulse Dy of clockwise rotation is supplied to the scanning line drive circuits 130L and 130R, the start pulse Dy of clockwise rotation is output as the end pulse EpyL during the period T1, provided that the scanning line drive circuit 130L is normal.

Note that the start pulse Dy of clockwise rotation is a positive pulse having a logic level that is the same as in the first embodiment. Also, the period T1 has the period length of the one period of the clock signal Cly, with a starting point in time when the (m/2) periods of the clock signal Cly have elapsed after the start pulse Dy has been supplied. The end pulse EpyL is logically inverted by the NOT circuit Inv2 to be output as an end pulse/EpyL. The signal Sr(4) is at the L level in the period T1, and thus the output signal from the NOR circuit Nor1 is to be the same signal as a signal re-inverted from the end pulse/EpyL, that is, the end pulse EpyL.

Accordingly, the output signal from the NOR circuit Nor1 appears during the period T1 as the waveform corresponding to the end pulse EpyL.

On the other hand, in the period T2 that the two periods of the clock signal Cly have elapsed from the T1 period, the end pulse EpyR output from the scanning line drive circuit 130R is output as the signal SR(4) by the sequential output circuit 210, provided that the scanning line drive circuit 130R is normal. However, in the period T2, the end pulse/EpyL is at the H level, and thus the output signal from the NOR circuit Nor1 is at the L level, regardless of the logic level of the signal SR(4).

Thus, the start pulse Dy of clockwise rotation is supplied when the signal Mode is at the H level, then, only the waveform corresponding to the end pulse EpyL appears in the signal Tout during the period T1.

When the start pulse Dy of counter-clockwise rotation is supplied to the scanning line drive circuits 130L and 130R, the start pulse Dy of counter-clockwise rotation is output as the end pulse EpyL during the period T1, provided that the scanning line drive circuit 130L is normal.

Note that the start pulse Dy of counter-clockwise rotation is a negative pulse that a start pulse of clockwise rotation is logically inverted. The end pulse EpyL is logically inverted by the NOT circuit Inv2 to be output as the end pulse/EpyL. However, the signal SR(4) is at the H level in the period T1, and thus the output signal output from the NOR circuit Nor1 is at the L level, irrespective of the end pulse/EpyL.

On the other hand, in the period T2, the end pulse EpyR output from the scanning line drive circuit 130R is output as the signal SR(4) by the sequential output circuit 210, provided that the scanning line drive circuit 130R is normal. In the period T2, the end pulse/EpyL is at the L level.

Thus, the start pulse Dy of counter-clockwise rotation is supplied when the signal Mode is at the H level, then, only the waveform corresponding to the end pulse EpyR appears in the signal Tout during the period T2.

As such, according to the modification example of the first embodiment, the start pulse Dy of clockwise rotation or counter-clockwise rotation is supplied to cause only the waveform corresponding to either one of the end pulse EpyL or EpyR to appear in the signal Tout. Thus, it is possible, when the signal Mode is at the L level, to clearly distinguish which waveform of the end pulses EpyL or EpyR is reflected in the signal Tout.

Note that in this modification example, the operation when the signal Mode is at the H level is the same as that in the first embodiment, and thus advantageous effects when the signal Mode is at the H level are the same.

Figure 9:
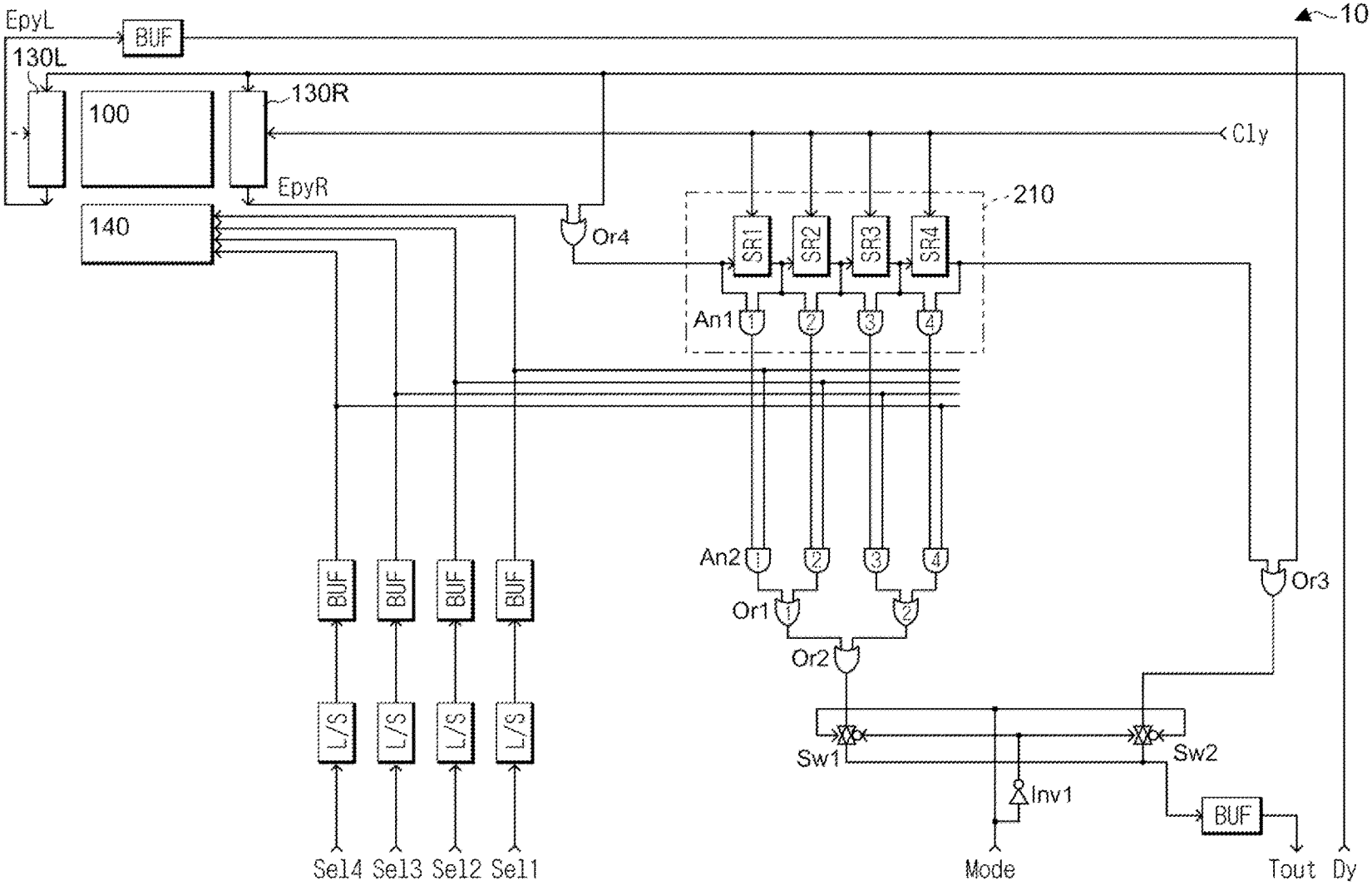
FIG. 9 is a diagram illustrating a configuration of an electro-optical device according to a second embodiment.

Next, a second embodiment will be described. FIG. 9 is a diagram illustrating a configuration of the electro-optical device 10 according to the second embodiment.

In FIG. 9, the input signal to the sequential output circuit 210 in FIG. 5 is replaced from the output signal from the scanning line drive circuit 130R to an output signal from the OR circuit Or4. Specifically, one of two input ends of the OR circuit Or4 is supplied with the end pulse EpyR output from the scanning line drive circuit 130R, and the other of the two input ends of the OR circuit Or4 is supplied with the start pulse Dy.

In the first embodiment, when, for example, the scanning line drive circuit 130R is abnormal, the start pulse Dy is not transferred and the end pulse EpyR fails to appear in the output signal from the signal SR(m), and when the signal Mode is constantly at the L level, it is impossible to monitor the control signals Sel1 to Sel4 reaching the demultiplexer 140. When intending only to distinguish a defective product of the electro-optical device 10, there is no issue even when the control signals Sel1 to Sel4 cannot be monitored because the scanning line drive circuit 130R has already been found to be defective.

However, there is a demand for monitoring the control signals Sel1 to Sel4 in order to improve the yield of the electro-optical device 10, even if the scanning line drive circuit 130R is abnormal. According to the second embodiment, the start pulse Dy is sequentially input via the OR circuit Or4 to the sequential output circuit 210, and thus the control signals Sel1 to Sel4 reaching the demultiplexer 140 can be monitored, even if the scanning line drive circuit 130R is abnormal.

Note that in the second embodiment, the configuration is the same as in the first embodiment for elements other than the OR circuit Or4. Accordingly, in the second embodiment as well, similar advantageous effects can be achieved as in the first embodiment.

Figure 10:
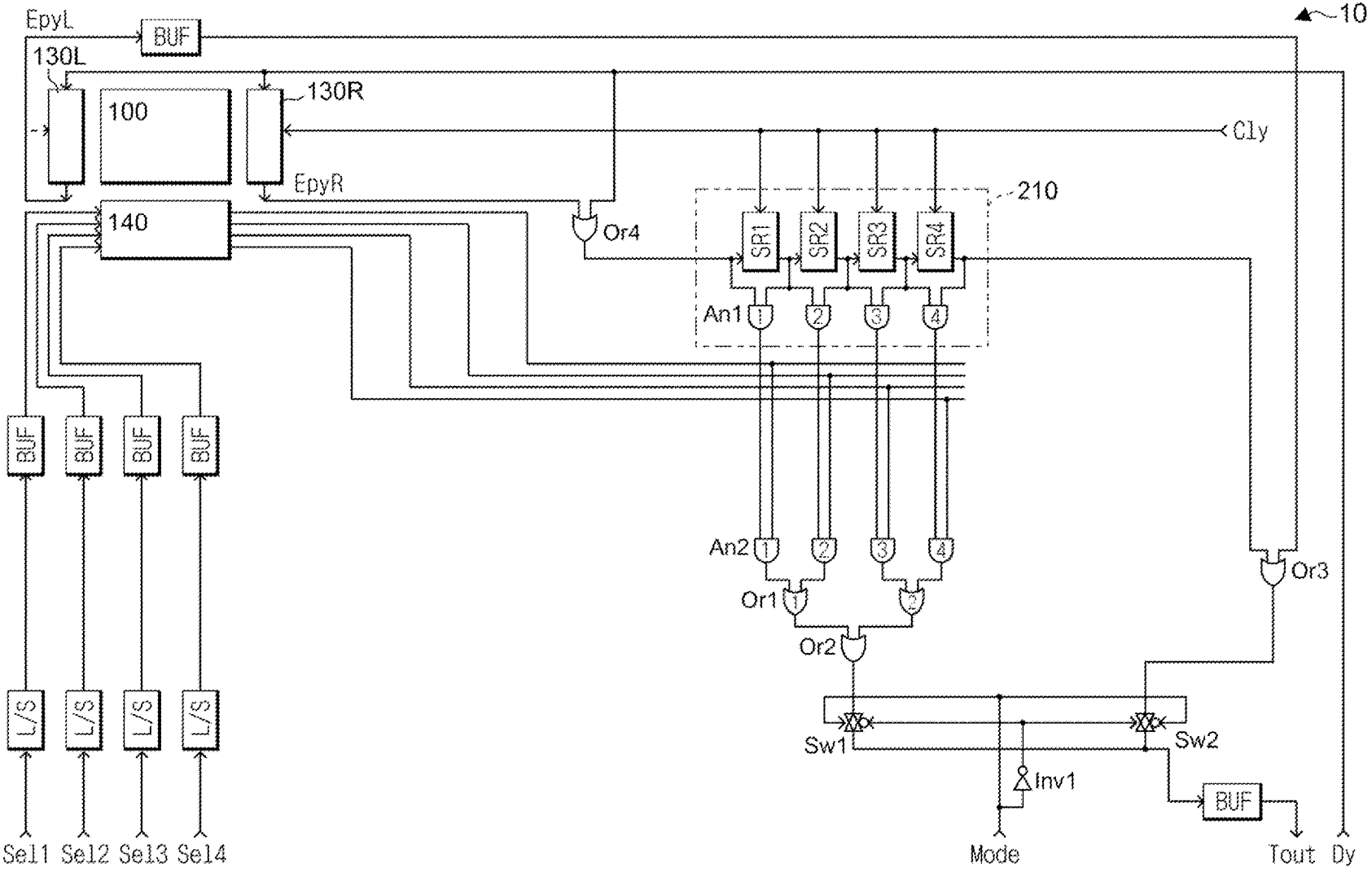
FIG. 10 is a diagram illustrating a configuration of an electro-optical device according to a third embodiment.

Next, a third embodiment will be described. FIG. 10 is a diagram illustrating a configuration of the inspection circuit 200 and the like of the electro-optical device 10 according to the third embodiment.

In FIG. 10, positions at which the control signals Sel1 to Sel4 are collected in the demultiplexer 140 differ from those in the first embodiment in FIG. 5 or the second embodiment in FIG. 9. Specifically, in the first embodiment, the configuration is employed in which the four pieces of signal lines 142 are supplied with the control signals Sel1 to Sel4 from the B side in FIG. 3 and the sequential output circuit 210 is also coupled to the B side to collect the control signals Sel1 to Sel4 at the supply side.

In contrast, in the third embodiment, a configuration is employed in which the four pieces of signal lines 142 are supplied with the control signals Sel1 to Sel4 from the A side, and the sequential output circuit 210 is coupled to the B side to collect the control signals Sel1 to Sel4 at the output side.

According to the third embodiment, the control signals Sel1 to Sel4 can be monitored in a state of not only reaching the demultiplexer 140, but also including the waveform dullness or a delay caused by passing through the signal line 142.

Thus, according to the third embodiment, the control signals Sel1 to Sel4 output from the display control circuit or the adjustment device can be adjusted at a more appropriate timing.

Note that in the third embodiment, only supply paths of the control signals Sel1 to Sel4 to the demultiplexer 140 differ from those of the second embodiment illustrated in FIG. 9. Accordingly, in the third embodiment as well, similar advantageous effects can be achieved as in the second embodiment.

Figure 11:
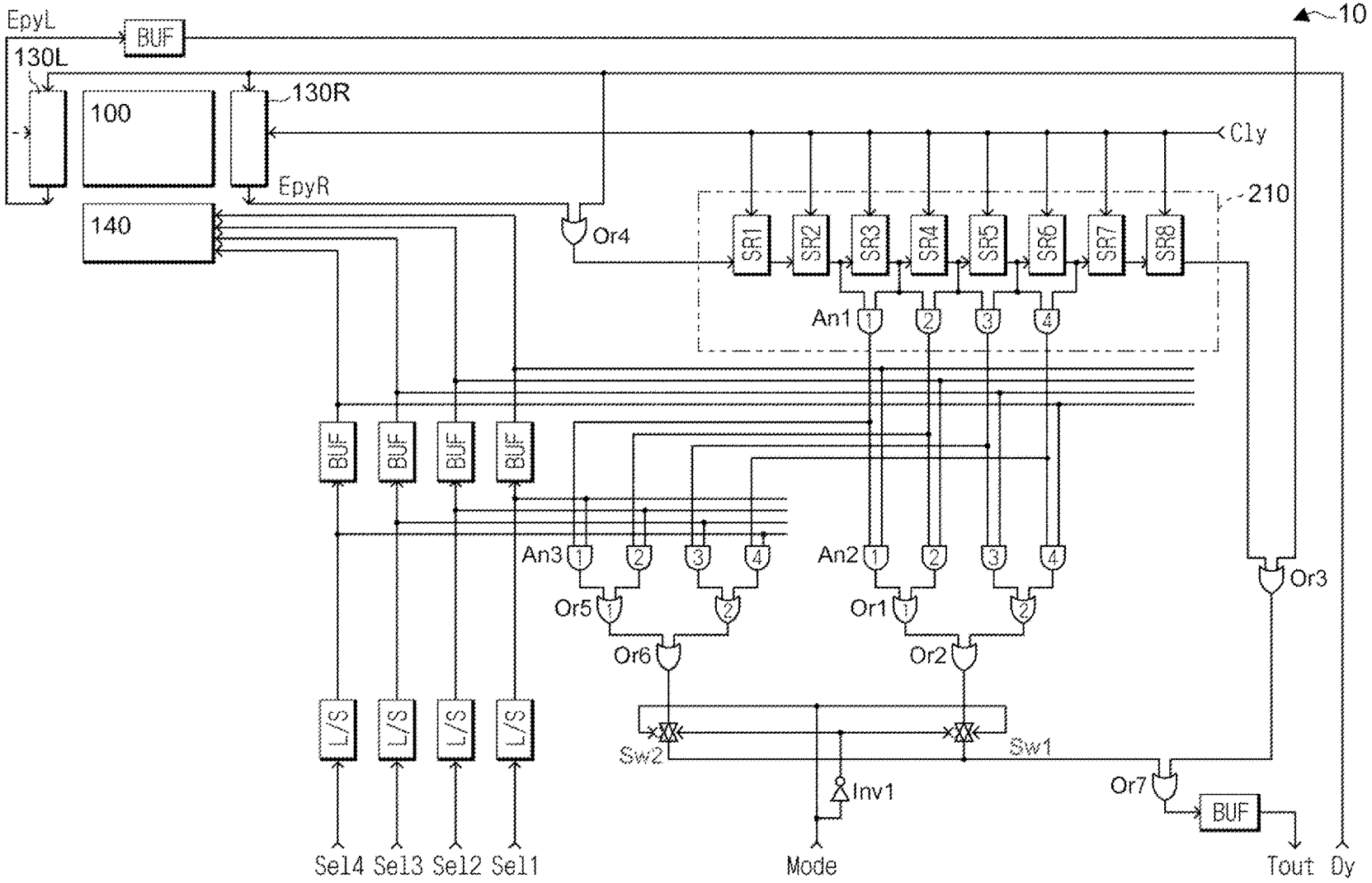
FIG. 11 is a diagram illustrating a configuration of an electro-optical device according to a fourth embodiment.

Next, a fourth embodiment will be described. FIG. 11 is a diagram illustrating a configuration of the inspection circuit 200 and the like of the electro-optical device 10 according to the fourth embodiment.

In FIG. 11, the following points mainly differ from the second embodiment illustrated in FIG. 9. That is, the fourth embodiment differs from the second embodiment in that the number of the stages of the sequential output circuit 210 is different, and AND circuits An3_1 to An3_4, and OR circuits Or5_1, Or5_2, Or6, and Or7 are included.

Note that a collection section for collecting the control signals Sel1 to Sel4 mean, but not limited to, an end portion of a wiring pattern in plan view of the signal line 142. The collection section may be any portion as long as after passing through switch groups constituting the demultiplexer 140 when viewed from the input side of the control signals Sel1 to Sel4.

Because the waveform dullness of the control signal Sel is almost saturated even remaining some of the switch groups constituting the demultiplexer 140, the collection section for collecting the control signals Sel1 to Sel4 may be provided at a middle of the demultiplexer 140. In other words, there may be a switch that constitutes the demultiplexer 140 before and after the collection section of the control signals Sel1 to Sel4.

In the fourth embodiment, the sequential output circuit 210 has the delay circuits SR1 to SR8 in eight stages, where the output signal from the delay circuit SR8 in the final stage is supplied to one of the two input ends of the OR circuit Or3. In addition, at the sequential output circuit 210, the AND circuit An1_1 is configured to output a logical product signal of the input signal to the delay circuit SR3 and the output signal from the delay circuit SR3, the AND circuit An1_2 is configured to output a logical product signal of the input signal to the delay circuit SR4 and the output signal from the delay circuit SR4, the AND circuit An1_3 is configured to output a logical product signal of the input signal to the delay circuit SR5 and the output signal from the delay circuit SR5, and the AND circuit An1_4 is configured to output a logical product signal of the input signal to the delay circuit SR6 and the output signal from the delay circuit SR6.

Further, the AND circuit An3_1 is configured to output a logical product signal of the output signal from the AND circuit An1_1 and the control signal Sel1 converted into a high amplitude signal by the level shifter. Note that the control signal Sel1 is a signal before input to the buffer. Similarly, the AND circuit An3_2 is configured to output a logical product signal of the output signal of the AND circuit An1_2 and the control signal Sel2 converted by the level shifter into a high amplitude signal, the AND circuit An3_3 is configured to output a logical product signal of the output signal from the AND circuit An1_3 and the control signal Sel3 converted by the level shifter into a high amplitude signal, and the AND circuit An3_4 is configured to output a logical product signal of the output signal from the AND circuit An1_4 and the control signal Sel4 converted by the level shifter into a high amplitude signal.

The OR circuit Or5_1 is configured to output a logical sum signal of the output signal from the AND circuit An3_1 and the output signal from the AND circuit An3_2, and the OR circuit Or5_2 is configured to output a logical sum signal of the output signal from the AND circuit An3_3 and the output signal from the AND circuit An3_4.

The OR circuit Or6 is configured to supply a logical sum signal of the output signal from the OR circuit Or5_1 and the output signal from the OR circuit Or5_2 to the input end of the transfer gate Sw2.

Note that a signal selected by the transfer gates Sw1 and Sw2 is supplied to one of two input ends of the OR circuit Or7, and the output signal from the OR circuit Or3 is supplied to the other of the two input ends of an OR circuit Or7.

In the fourth embodiment, an output signal from the OR circuit Or7, that is, a logical sum signal of a selection signal by the transfer gates Sw1 and Sw2 and the output signal from the OR circuit Or3 is output as the signal Tout via the buffer.

Note that in the fourth embodiment, the signal Mode is simply a signal specifying the turning ON of any one of the transfer gates Sw1 and Sw2, rather than a signal specifying a switching of a case of inspecting the scanning line drive circuits 130L and 130R, or a case of adjusting the timings of the control signals Sel1 to Sel4.

Figure 12:
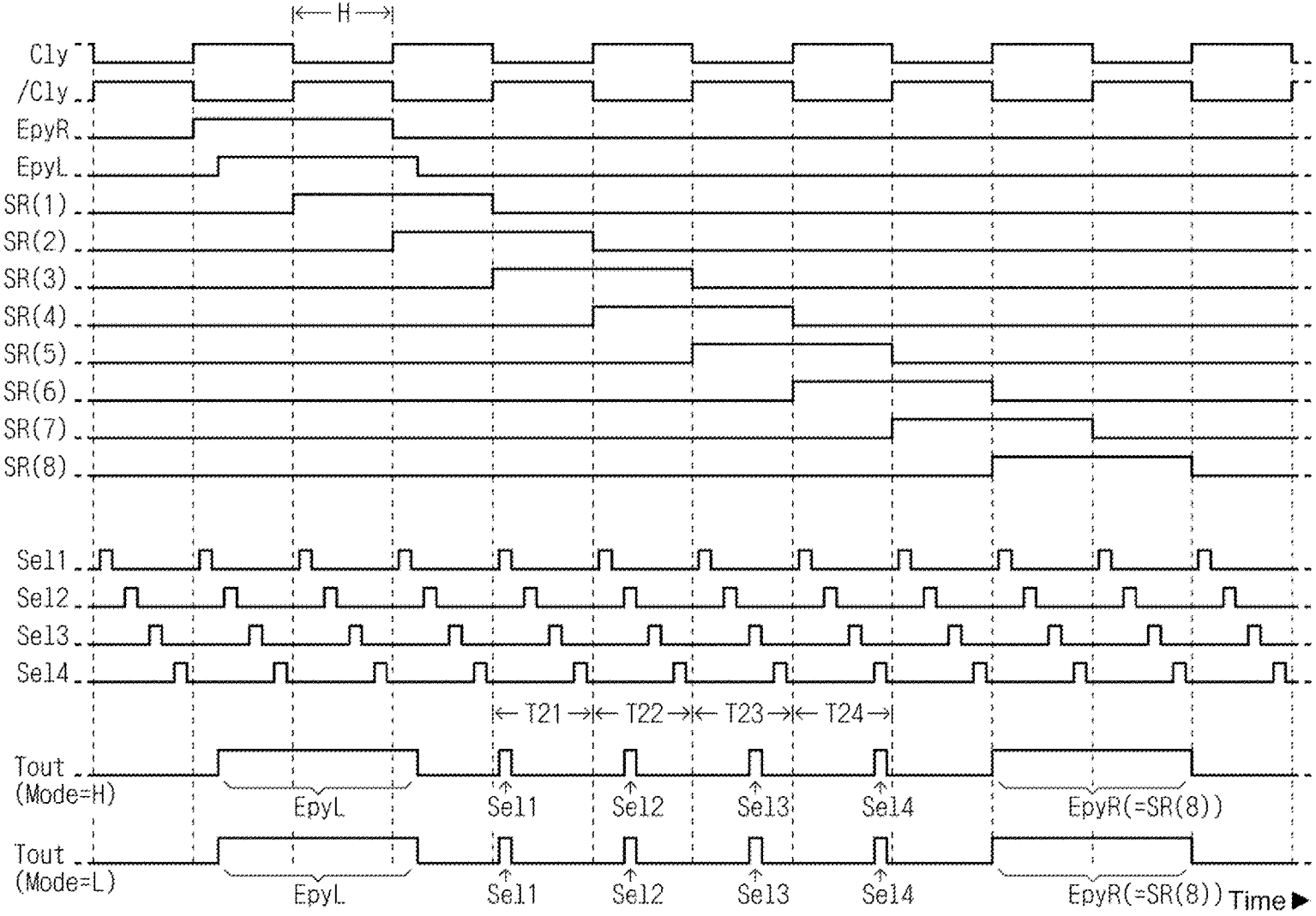
FIG. 12 is an explanatory chart illustrating an operation of an inspection circuit of a fourth embodiment.

FIG. 12 is an explanatory chart illustrating an operation of the inspection circuit 200 of the electro-optical device 10 according to the fourth embodiment.

In the fourth embodiment, when the signal Mode is at the H level, the transfer gate Sw1 turns ON and the transfer gate Sw2 turns OFF. Accordingly, the signal Tout is a logical sum signal of the end pulse EpyL by the scanning line drive circuit 130L, the signal SR(8) that the end pulse EpyR by the scanning line drive circuit 130R is delayed by the sequential output circuit 210, and a signal extracted, in response to the output signals from the AND circuits An1_1 to An1_4, from the control signals Sel1 to Sel4 output from the buffer. Note that the end pulse EpyR by the scanning line drive circuit 130R is delayed by four periods of the clock signal Cly by the sequential output circuit 210, to be output as the signal SR(8).

In the fourth embodiment, when the signal Mode is at the H level, a waveform reflecting the end pulse EpyL initially appear in the signal Tout. Subsequently, the respective waveforms reflecting the control signals Sel1 to Sel4, which have passed through the level shifter and buffer, appear in this order in each of the periods T21 to T24. Lastly, a waveform reflecting the end pulse EpyR delayed by the sequential output circuit 210 appears.

On the other hand, in the fourth embodiment, when the signal Mode is at the L level, the transfer gate Sw1 turns OFF and the transfer gate Sw2 turns ON. Accordingly, the signal Tout is a logical sum signal of the end pulse EpyL, the signal SR(8) that the end pulse EpyR is delayed by the sequential output circuit 210, and a signal extracted, in response to the output signals from the AND circuits An1_1 to An1_4, from the control signals Sel1 to Sel4 having been converted into a high amplitude signal by the level shifter.

In the fourth embodiment, when the signal Mode is at the L level, the end pulse EpyL, the end pulse EpyR delayed by the sequential output circuit 210, and the signal extracted, in each of the periods T21 to T24, from the control signals Sel1 to Sel4 in this order, which have passed through the level shifter, but not have passed through the buffer, appear in the signal Tout.

Thus, according to the fourth embodiment, a difference between the signal Tout when the signal Mode is at the H level and the signal Tout when the signal Mode is at the L level is examined, to facilitate specifying a portion that is defective.

Specifically, the waveform reflecting the control signal Sel2 appears, during the period T22, in the signal Tout when the signal Mode is at the L level, and it can be specified that the buffer for the control signal Sel2 is defective while the level shifter for the control signal Sel2 is normal, provided that the waveform reflecting the control signal Sel2 does not appear, during the period T22, in the signal Tout when the signal Mode is at the H level.

In another example, when a selection Duty of the control signal Sel2 is increased as a case when the signal Mode is at the L level, it can be determined that the level shifter for the control signal Sel2 cannot be operating at a predetermined speed in such a case when a signal reflecting the control signal Sel2 appears in the signal Tout.

Figure 13:
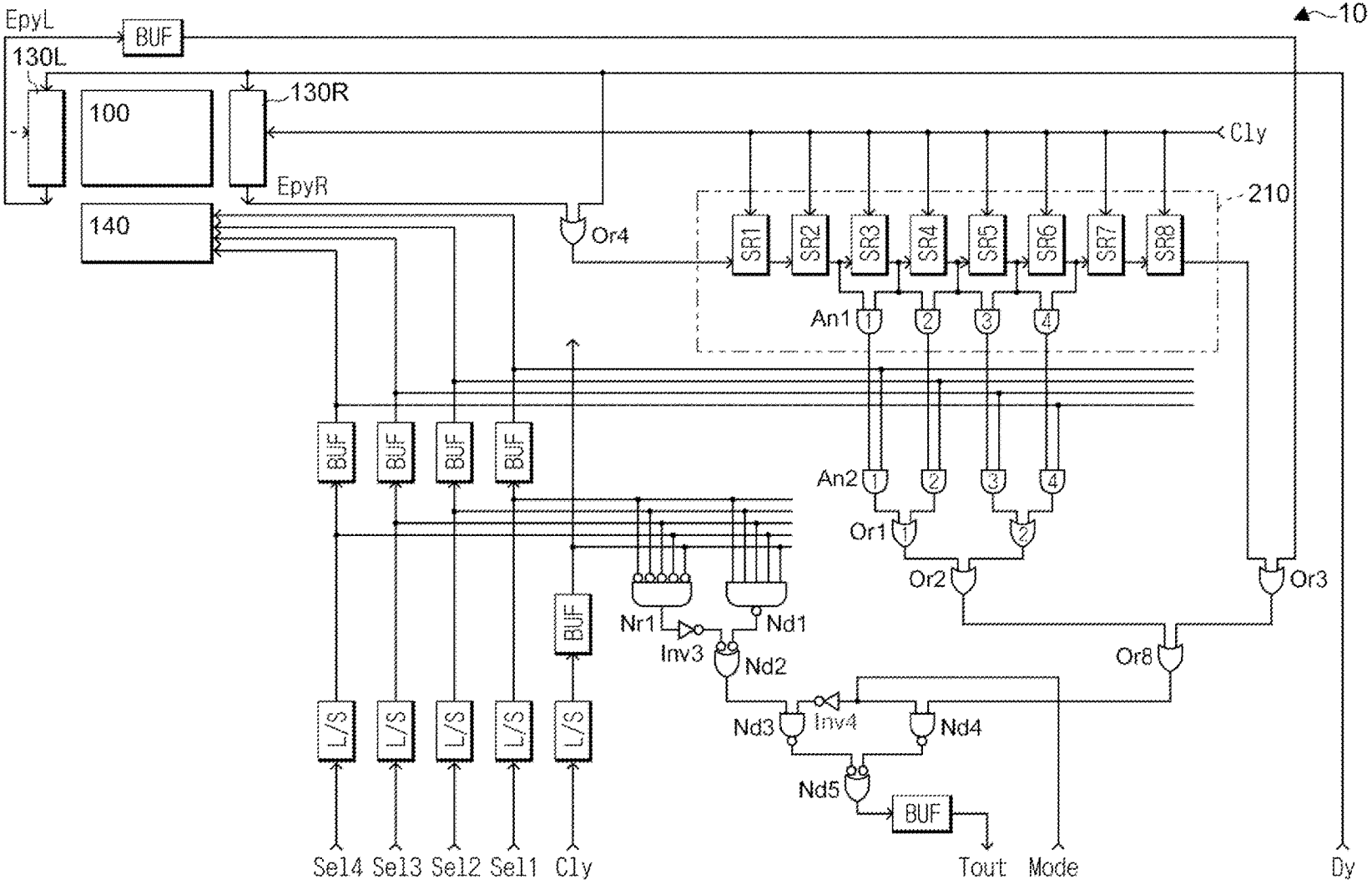
FIG. 13 is a diagram illustrating a configuration of an electro-optical device according to a fifth embodiment.

A fifth embodiment will be described. FIG. 13 is a diagram illustrating a configuration of the inspection circuit 200 and the like of the electro-optical device 10 according to the fifth embodiment.

In FIG. 13, the following points mainly differ from the fourth embodiment illustrated in FIG. 11. That is, the fifth embodiment differs from the fourth embodiment in including a NOR circuit Nr1, NAND circuits Nd1 to Nd5, a NOT circuit Inv4, and an OR circuit Or8, instead of not including the AND circuits An3_1 to An3_4, the OR circuits Or5_1, Or5_2, Or6, and Or7, the NOT circuit Inv1, and the transfer gates Sw1 and Sw2.

Further, in the fifth embodiment, although some of the paths are omitted, the clock signal Cly is being supplied, via the level shifter and buffer, to the NOR circuit Nr1, the NAND circuit Nd1, the scanning line drive circuits 130L and 130R, and the sequential output circuit 210.

The NOR circuit Nr1 and the NAND circuit Nd1 are logical operation circuits for inspecting five pieces in total of the level shifters that convert the control signals Sel1 to Sel4 and the clock signal Cly into high amplitude signals. Among these components, the NOR circuit Nr1 is configured to generate, while being in a first state, a negative logical sum signal of the control signals Sel1 to Sel4 having passed through the level shifter and the clock signal Cly having passed through the level shifter and buffer, and to output the negative logical sum signal. Note that the first state refers to a state where the control signals Sel1 to Sel4 and the clock signal Cly are all output at the L level by the display control circuit or the adjustment device. The NOT circuit Inv3 is configured to output a negative signal of an output signal by the NOR circuit Nr1.

The NAND circuit Nd1 is configured to generate, while being in a second state, a negative logical product signal of the control signals Sel1 to Sel4 having passed through the level shifter and the clock signal Cly having passed through the level shifter and buffer, and to output the negative logical product signal. Note that the second state refers to a state where the control signals Sel1 to Sel4 and the clock signal Cly are all output at the H level by the display control circuit or the adjustment device.

The NAND circuit Nd2 is configured to output a negative logical product signal of the output signal from the NOT circuit Inv3 and the output signal from the NAND circuit Nd1.

On the other hand, in the fifth embodiment, the signal Mode is supplied to an input end of the NOT circuit Inv4 and one of two input ends of the NAND circuit Nd4. The NAND circuit Nd3 is configured to output a negative logical product signal of the output signal from the NAND circuit Nd2 and an output signal from the NOT circuit Inv4.

Further, the OR circuit Or8 is configured to output a logical sum signal of the output signal from the OR circuit Or2 and the output signal from the OR circuit Or3 to the other of the two input ends of the NAND circuit Nd4. The NAND circuit Nd4 is configured to output a negative logical product signal of an output signal from the OR circuit Or8 and the signal Mode, the NAND circuit Nd5 is configured to output a negative logical product signal of the output signal from the NAND circuit Nd3 and the output signal from the NAND circuit Nd4. In the fifth embodiment, the signal Tout is the output signal from the OR circuit Or8, provided that the signal Mode is at the H level, and is an output signal from the NAND circuit Nd2, provided that the signal Mode is at the L level. That is, the NAND circuits Nd3 to Nd5 and the NOT circuit Inv4 of the fifth embodiment function as selection circuits that are similar to the transfer gates Sw1 and Sw2 in the first embodiment and the like.

Figure 14:
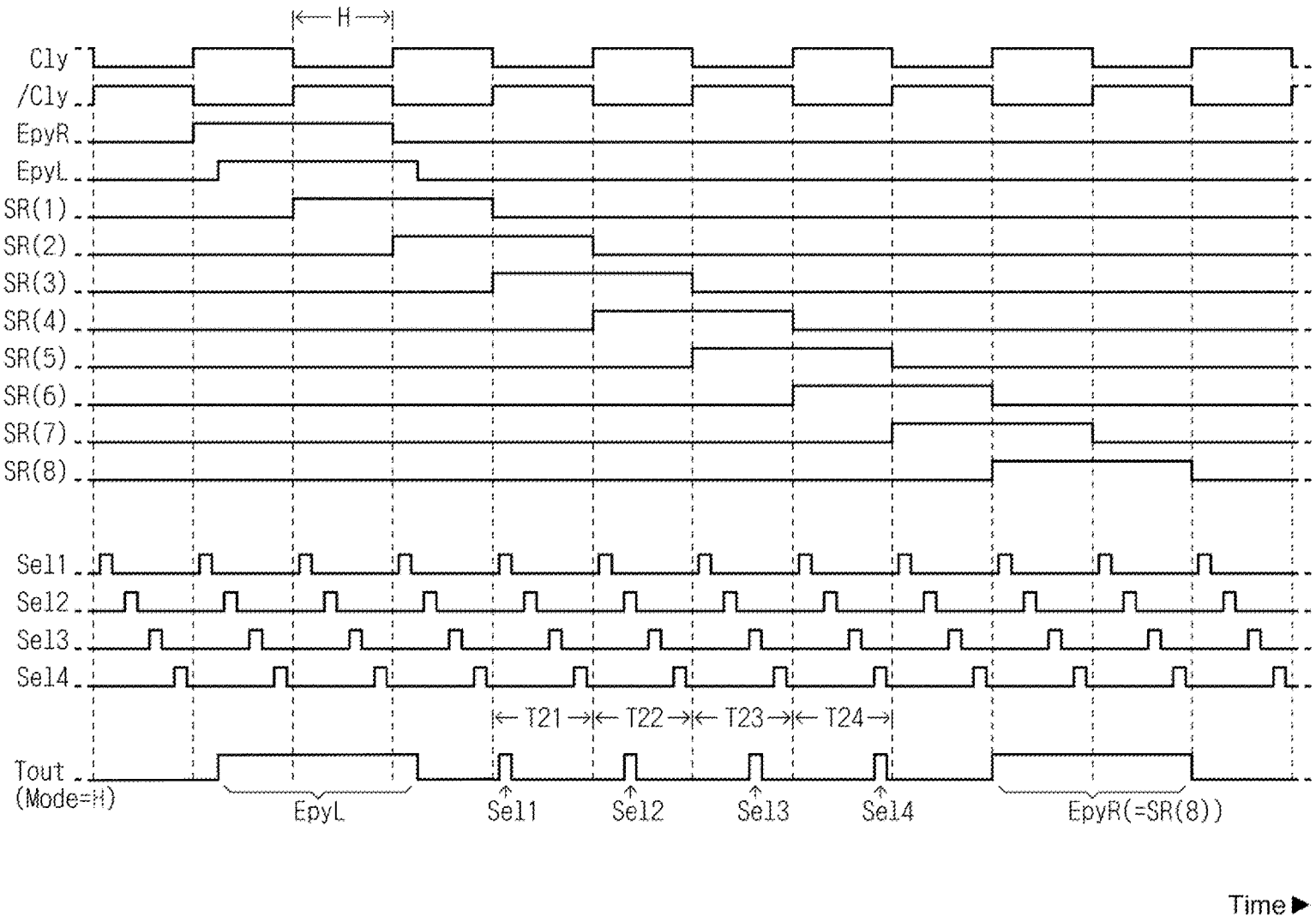
FIG. 14 is an explanatory chart illustrating an operation of an inspection circuit of a fifth embodiment.

FIG. 14 is an explanatory chart illustrating an operation of the inspection circuit 200 of the electro-optical device 10 according to the fifth embodiment.

In the fifth embodiment, when the signal Mode is at the H level, the waveform reflecting the end pulse EpyL initially appear in the signal Tout. Subsequently, the respective waveforms reflecting the control signals Sel1 to Sel4, which have passed through the level shifter and buffer, appear in this order in each of the periods T21 to T24. Lastly, the waveform reflecting the end pulse EpyR delayed by the sequential output circuit 210 appears.

In the first state where the display control circuit or the adjustment device outputs, at the L level, all of the control signals Sel1 to Sel4 and the clock signal Cly when the signal Mode is at the L level, the signals at five input ends of the NOR circuit Nr1 are all set to the L level, provided that the five pieces of the level shifters are all normally operating. Accordingly, the output signal from the NOR circuit Nr1 is set to the H level. Thus, the output signal from the NOT circuit Inv3 is set to the L level. On the other hand, the output signal from the NAND circuit Nd1 is set to the H level.

Accordingly, the output signal from the NAND circuit Nd2 is set to the H level, provided that the five pieces of the level shifters are all normal.

The output signal from the NOR circuit Nr1 is set to the L level, provided that any one of the level shifters is abnormal. Thus, the output signal from the NOT circuit Inv3 is set to the H level. The output signal from the NAND circuit Nd1 is set to the H level. That is, the output signal from the NAND circuit Nd2 is set to the L level. In the second state where the display control circuit or the adjustment device outputs, at the L level, all of the control signals Sel1 to Sel4 and the clock signal Cly when the signal Mode is at the L level, the signals at the five input ends of the NOR circuit Nr1 are all set to the H level, provided that the five pieces of the level shifters are all normally operating. Accordingly, the output signal from the NOR circuit Nr1 is set to the L level. Thus, the output signal from the NOT circuit Inv3 is set to the H level. On the other hand, accordingly, the output signal from the NAND circuit Nd1 is set to the L level.

Accordingly, the output signal from the NAND circuit Nd2 is set to the H level, provided that the five pieces of the level shifters are all normal.

The output signal from the NOR circuit Nr1 is set to the L level, provided that any one of the level shifters is abnormal. Thus, the output signal from the NOT circuit Inv3 is set to the H level. The output signal from the NAND circuit Nd1 is set to the H level. That is, the output signal from the NAND circuit Nd2 is set to the L level. The signal output as the signal Tout when the signal Mode is at the L level is the output signal from the NAND circuit Nd2.

Accordingly, it can be determined, when the signal Mode is at the L level, that the five pieces of the level shifters are all normal, provided that the signal Tout is at the H level after having passed through the first state and the second state. In addition, when logically inverting a signal of any one of the control signals Sel1 to Sel4 and the clock signal Cly, the output of the signal Tout is set to the counter-clockwise rotation, to enable a verification of an operation speed of the level shifter for each of the signals.

Note that a signal output as the signal Tout when the signal Mode is at the H level is the output signal from the OR circuit Or8. The output signal from the OR circuit Or8 is a logical sum signal of the output signal from the OR circuit Or2 and the output signal from the OR circuit Or3, where the logical sum signal is equivalent to the output signal from the OR circuit Or7 when the signal Mode is at the H level in the fourth embodiment.

Thus, the signal Tout when the signal Mode is at the H level in the fifth embodiment has a similar waveform as in the signal Tout when the signal Mode is at the H level in the fourth embodiment.

As such, according to the fifth embodiment, an inspection for the five pieces of the level shifters becomes possible in addition to the inspection of the scanning line drive circuits 130L and 130R and the monitoring of the control signals Sel1 to Sel4.

Note that in the fifth embodiment, the level shifter for the clock signal Cly is added to the inspection targets in addition to the control signals Sel1 to Sel4, and other signals, that is, for example, the clock signal/Cly, the start pulse signal Dy, or the enable signal for shaping the scanning signal may be included in the inspection targets.

Also, in the fifth embodiment, the NAND circuits Nd3 to Nd5 and the NOT circuit Inv4 are configured to select the output signal from the OR circuit Or8 provided that the signal Mode is at the H level, and to select the output signal from the NAND circuit Nd2 provided that the signal Mode is at the L level, where these selections may be interchanged.

Figure 15:
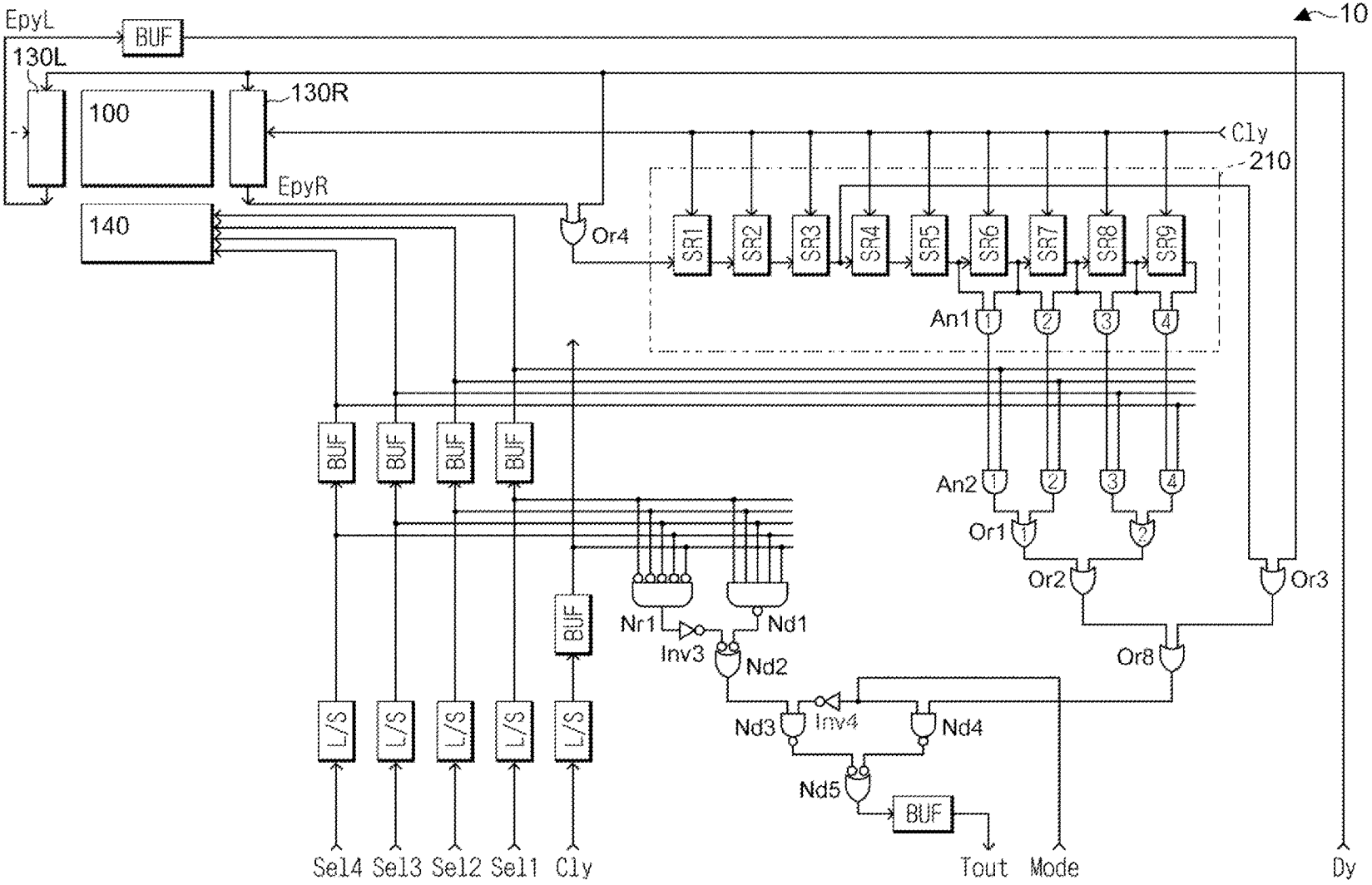
FIG. 15 is a diagram illustrating a modification example of a fifth embodiment.

Next, a modification example of the fifth embodiment will be described. FIG. 15 is a diagram illustrating a configuration of the inspection circuit 200 and the like according to the modification example of the fifth embodiment.

In FIG. 15, the configuration of the sequential output circuit 210 in FIG. 13 is modified.

Specifically, as illustrated in FIG. 15, first, the number of the stages of the delay circuits of the sequential output circuit 210 is changed from "8" to "9".

Next, a relationship between the delay circuit and the AND circuits An_1 to An_4 of the sequential output circuit 210 is modified. Specifically, the AND circuit An1_1 is configured to output a logical product signal of the input signal to the delay circuit SR6 and the output signal from the delay circuit SR6, the AND circuit An1_2 is configured to output a logical product signal of the input signal to the delay circuit SR7 and the output signal from the delay circuit SR7, the AND circuit An1_3 is configured to output a logical product signal of the input signal to the delay circuit SR8 and the output signal from the delay circuit SR8, and the AND circuit An1_4 is configured to output a logical product signal of the input signal to the delay circuit SR9 and the output signal from the delay circuit SR9.

Moreover, the output signal from the sequential output circuit 210 is modified. Specifically, the output of the sequential output circuit 210 is changed to the output signal from the delay circuit SR3, which is at a middle stage, rather than the delay circuit in the final stage, and the output signal SR(3) output from the delay circuit SR3 is supplied to one of the two input ends of the OR circuit Or3.

Figure 16:
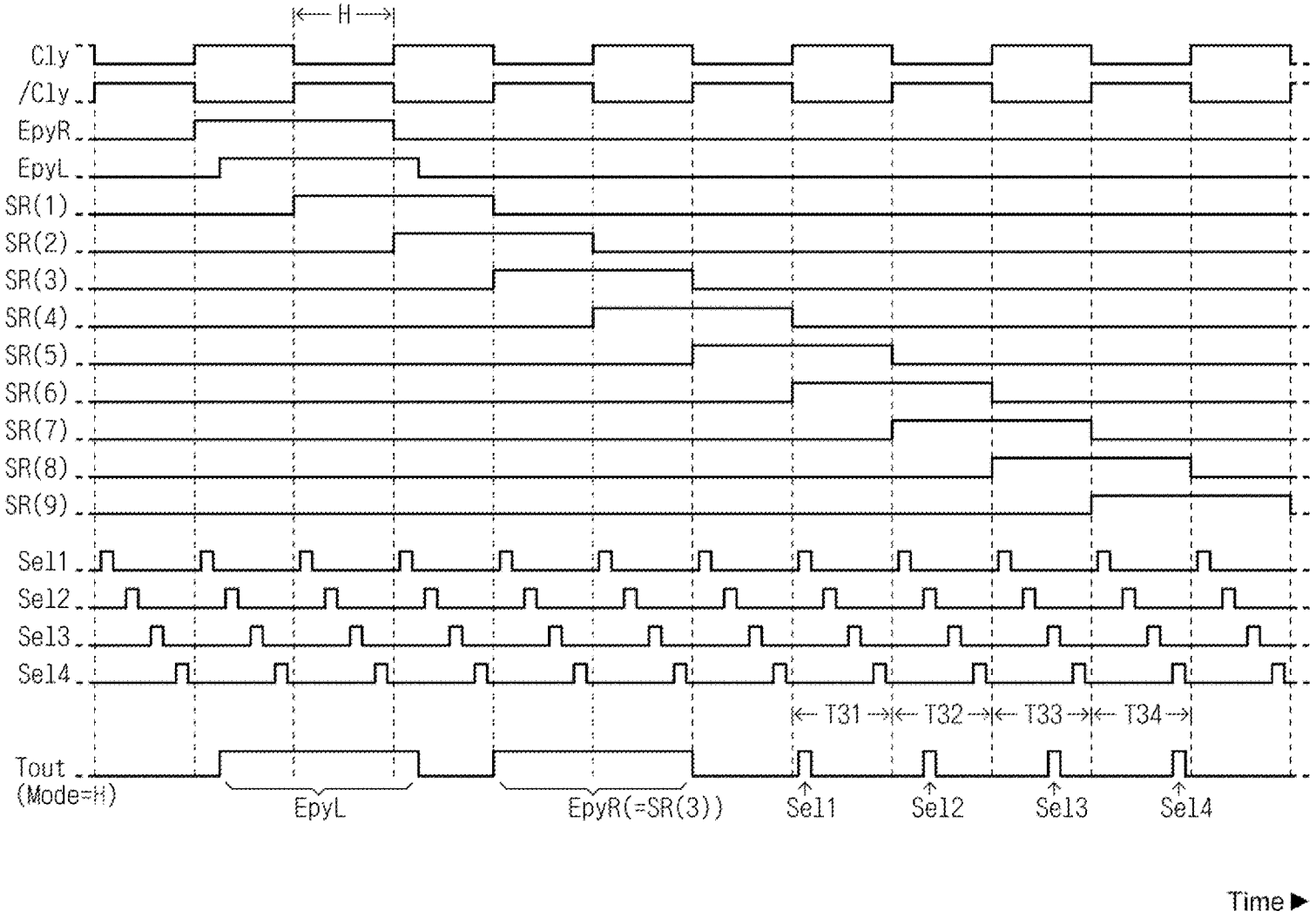
FIG. 16 is an explanatory chart illustrating an operation of an inspection circuit in a modification example of a fifth embodiment.

FIG. 16 is an explanatory chart illustrating an operation of the inspection circuit 200 of the electro-optical device 10 according to the modification example of the fifth embodiment.

The operation when the signal Mode is at the L level is the same as in the fifth embodiment illustrated in FIG. 13.

In the modification example of the fifth embodiment, the output signal from the sequential output circuit 210 is the signal SR(3) output from the delay circuit SR3.

Accordingly, the waveform reflecting the end pulse EpyR that appears in signal Tout when the signal Mode is at the H level is to be delayed by 1.5 periods of the clock signal Cly with respect to the waveform reflecting the end pulse EpyL.

In addition, the AND circuit An1_1 is set to the H level in the period T31 in which the signals SR(5) and SR(6) are both set to the H level. Note that a start timing of the period T31 is a timing at which the end pulse EpyR from the scanning line drive circuit 130R is input to the delay circuit SR1 to be delayed by three periods of the clock signal Cly.

The AND circuit An1_2 is set to the H level in a period T32 following the period T31, in which the signals SR(6) and SR(7) are both set to the H level. Similarly, the AND circuit An1_3 is set to the H level in a period T33 following the period T32, in which the signals SR(7) and SR(8) are both set to the H level, and the AND circuit An1_4 is set to the H level in a period T34 following the period T33, in which the signals SR(8) and SR(9) are both set to the H level. Thus, in the modification example of the fifth embodiment, the waveform reflecting the control signal Sel1 appears, when the signal Mode is at the H level, in the signal Tout during the period T31, and hereinafter similarly, the respective waveforms reflecting the control signals Sel2 to Sel4 appear in this order in the periods T32 to T34.

As such, according to the modification example of the fifth embodiment, waveforms reflecting the end pulses EpyL and EpyR, and the control signals Sel1 to Sel4 appear, when the signal Mode is at the H level, in the signal Tout in time sequence. Accordingly, according to the modification example, the respective waveforms reflecting the control signals Sel1 to Sel4 are not interposed between the respective waveforms reflecting the end pulses EpyL and EpyR, contrary to the fifth embodiment. Thus, the modification example is suitable when the scanning line drive circuits 130L and 130R and the monitoring of the control signals Sel1 to Sel4 need to be distinguished in time.

Note that, as is recognizable from the fifth embodiment and the modification example of this embodiment, the waveform reflecting the end pulse EpyR, the waveform reflecting the end pulse EpyR, and the respective waveforms reflecting the control signals Sel1 to Sel4 are freely sequenced unless the waveforms does not superimpose on one another in time.

Also, in the first to fifth embodiments or the modification examples of these embodiments, the configuration is employed in which the scanning signal is supplied to one piece of the scanning line by one pair of a delay circuit and an AND circuit at the scanning line drive circuits 130L and 130R, and a configuration may also be employed in which the scanning signals output from the delay circuit and the AND circuit are four scanning signals output by four enable signals, for example. Note that in this configuration, the half period of the clock signal Cly coincides with four horizontal scanning periods.

Such a configuration is employed when, for example, one stage of the delay circuit constituting the scanning line drive circuits 130L and 130R cannot be made to correspond to one scanning line. Four enable signals ENBY1, ENBY2, ENBY3, and ENBY4 are signals that determine a selection period of the scanning line 112 with a partial period of one horizontal scanning period being a selection state, for every four horizontal scanning periods.

In this case, FIG. 5 that illustrates the first embodiment is modified as follows. First, a logical product circuit is added, which is configured to output a logical product signal of the output signal from the AND circuit An1_1 and the enable signal ENBY1. The output signal from the logical product circuit and the control signal Sel1 are input to the AND circuit An2_1.

Similarly, a logical product circuit is added, which is configured to output a logical product signal of the output signal from the AND circuit An1_2 and the enable signal ENBY2. The output signal from the logical product circuit and the control signal Sel2 are input to the AND circuit An2_2.

Similarly, a logical product circuit is added, which is configured to output a logical product signal of the output signal from the AND circuit An1_3 and the enable signal ENBY3. The output signal from the logical product circuit and the control signal Sel3 are input to the AND circuit An2_3.

Similarly, a logical product circuit is added, which is configured to output a logical product signal of the output signal from the AND circuit An1_4 and the enable signal ENBY43. The output signal from the logical product circuit and the control signal Sel4 are input to the AND circuit An2_4.

By configuring as such, the respective waveforms reflecting the control signals Sel1 to Sel may be sequentially output for every horizontal scanning periods.

Next, an example of an electronic apparatus using any one of the electro-optical devices 10 according to the first to fifth embodiments described above will be described.

Figure 17:
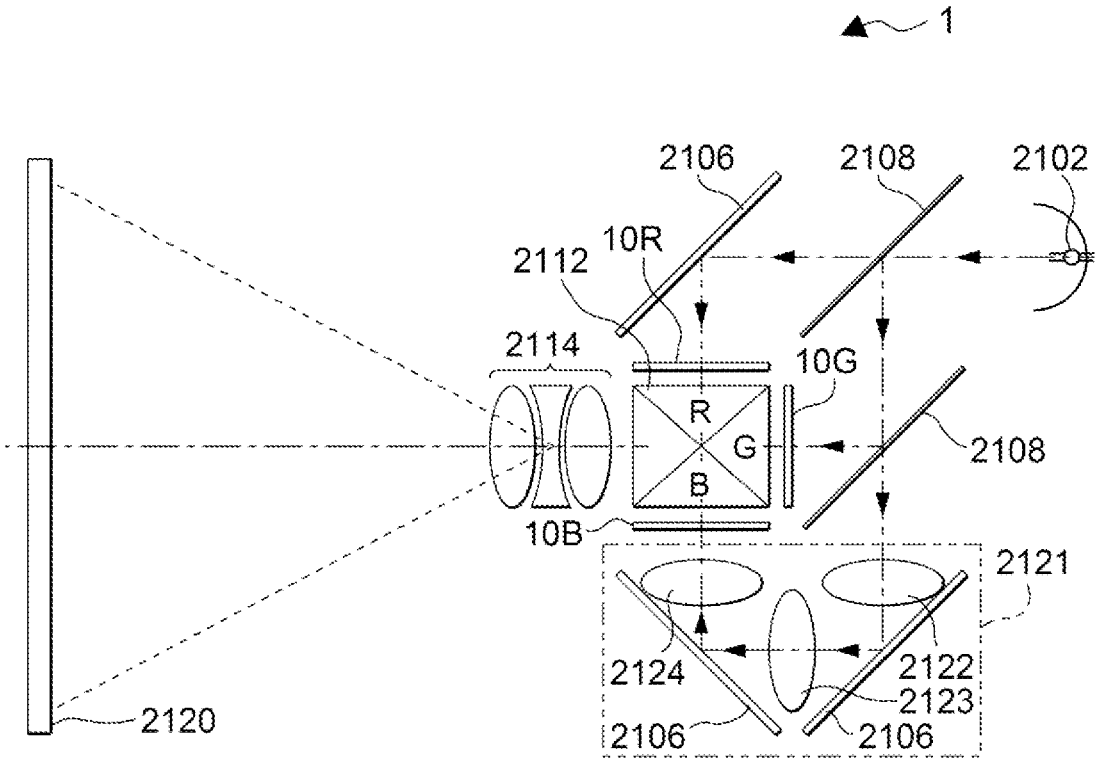
FIG. 17 is a diagram illustrating one example of an electronic apparatus using an electro-optical device.

FIG. 17 is a diagram illustrating a configuration of a liquid crystal projector 1, which is one example of an electronic apparatus. The liquid crystal projector 1 is of a three-plate type that uses, as a light valve, the electro-optical device 10 of any one of the first to fifth embodiments.

As illustrated in FIG. 17, the liquid crystal projector 1 includes electro-optical devices 10R, 10G, and 10B. The electro-optical devices 10R, 10G, and 10B, which are the same as the electro-optical device 10 of the embodiments and the like, are each configured to generate a transmission image based on projected image data corresponding to respective colors of R, G, and B supplied from an upper circuit.

Inside the liquid crystal projector 1 is provided with a lamp unit 2102 constituted by a white light source such as a halogen lamp. Projection light emitted from this lamp unit 2102 is split into three primary colors of red, green, and blue by three mirrors 2106 and two dichroic mirrors 2108 installed inside. Among these colors, the red light is incident on the electro-optical device 10R, the green light is incident on the electro-optical device 10G, and the blue light is incident on the electro-optical device 10B.

Note that an optical path for the blue is longer than those for other red and green. Thus, the blue light is guided to the electro-optical device 10B via a relay lens system 2121 composed of an incidence lens 2122, a relay lens 2123, and an emission lens 2124, to prevent a loss at the optical path.

The electro-optical device 10R is configured to cause the scanning line drive circuits 130L and 130R and the demultiplexer 140 to supply a data signal of a red component to the pixel circuit 110. In the electro-optical device 10R, when a data signal is supplied for each of the pixel circuits 110, the liquid crystal element 120 included in the pixel circuit 110 has a transmittance in accordance with the data signal. Thus, in the electro-optical device 10R, the incident red light is controlled in transmittance for each of the pixels, and thus a transmission image of the red component among images to be displayed will be generated.

Similarly, in the electro-optical devices 10G and 10B, a data signal of a green component and a data signal of a blue component are supplied for each of the pixel circuits 110, to generate a transmission image of the green component and a transmission image of the blue component of the respective images to be displayed.

The transmission images of the respective colors generated by the electro-optical devices 10R, 10G, and 10B, respectively, is incident on a dichroic prism 2112 from three directions. Then, at this dichroic prism 2112, the light ray of R and the light ray of B are refracted at 90 degrees, whereas the light ray of G travels in a straight line. Thus, images of the respective colors are synthesized, and then a color image is projected on a screen 2120 by a projection lens 2114.

Note that the respective transmittance images by the electro-optical devices 10R and 10B are projected after being reflected by the dichroic prism 2112, while the transmittance image by the electro-optical device 10G travels in a straight line to be projected. Thus, the respective transmittance images of by the electro-optical devices 10R and 10B has a left-right inverted relationship with respect to the transmittance image of the electro-optical device 10G.

The electro-optical device 10 is of a transmissive type, and may also be of a reflective type, and other electro-optical elements such as an organic EL element may be used without being limited to the liquid crystal element 120.

From the various types of aspects exemplified above, the following aspects are comprehended, for example.

An electro-optical device according to one aspect (Aspect 1) includes a first switch provided between an input node supplied with a data signal and a first data line, the first switch being configured to be turned ON or OFF by a first control signal, a second switch provided between the input node and a second data line, the second switch being configured to be turned ON or OFF by the first control signal, a sequential output circuit configured to output a first pulse, and a second pulse exclusive of the first pulse, logical operational first logical operation circuit configured to acquire a first logical product signal of the first control signal and the first pulse, and a second logical product signal of the second control signal and the second pulse, and a second logical operation circuit configured to generate a logical sum signal of the first logical product signal and the second logical product signal.

According to the above aspect, a time interval appears in an expanded manner between a waveform reflecting the first control signal and a waveform reflecting the second control signal in the logical sum signal output from the second logical operation circuit, to facilitate distinguishing the signals.

Note that, as for the j-th group, the data line 114 in the (4j−3)-th row of the first sequence is one example of the first data line, and the data line 114 in the (4j−2)-th row of the second sequence is one example of the second data line. The control signal Sel1 is one example of the first control signal, and the control signal Sel2 is one example of the second control signal. The transistor Q1 is one example of the first switch, and the transistor Q2 is one example of the second switch. The output signal from the AND circuit An2_1 is one example of the first pulse, and the output signal from the AND circuit An2_2 is one example of the second pulse. The AND circuits An2_1 and An2_2 are one example of the first logical operation circuit, and the OR circuit Or1_1 or the Or2 is one example of the second logical operation circuit.

A specific aspect (Aspect 2) of Aspect 1 includes a scanning line drive circuit configured to sequentially delay a start pulse according to a clock signal to drive a first scanning line and a second scanning line, in which a sequential output circuit is configured to output the second pulse based on a signal delayed from the first pulse, according to the clock signal.

According to the above aspect, the clock signal used in the scanning line drive circuit is used to generate the first pulse and the second pulse at the sequential output circuit.

Note that the scanning line 112 in the first column is one example of the first scanning line, and the scanning line 112 in the second column is one example of the second scanning line.

In a specific aspect (Aspect 3) of Aspect 2, the scanning line drive circuit includes delay circuits cascaded in a plurality of stages, in which among the delay circuits cascaded in the plurality of stages, the start pulse is input to the delay circuit in a first stage, the delay circuit in a final stage is configured to output an end pulse, and in which the sequential output circuit is configured to generate the first pulse based on the end pulse.

According to the above aspect, the end pulse output from the scanning line drive circuit can be used to generate the first pulse.

In a specific aspect (Aspect 4) of Aspect 3, the scanning line drive circuit includes the first scanning line drive circuit and the second scanning line drive circuit, in which the electro-optical device further includes a third logical operation circuit configured to generate a logical sum signal of a first end pulse output from the first scanning line drive circuit and a signal delayed by the sequential output circuit from a second end pulse output from the second scanning line drive circuit.

According to the above aspect, in the logical sum signal output from the third logical operation circuit, a waveform reflecting the first end pulse and a waveform reflecting the second end pulse appear in a separate manner in time, to enable an inspection of the first scanning line drive circuit and the second scanning line drive circuit.

Note that the scanning line drive circuit 130L is one example of the first scanning line drive circuit, and the scanning line drive circuit 130R is one example of the second scanning line drive circuit.

A specific aspect (Aspect 5) of Aspect 4 includes a first selection circuit configured to select either one of the logical sum signal by the second logical operation circuit or the logical sum signal by the third logical operation circuit. According to the above aspect, a monitoring of the first control signal and the second control signal, and an inspection of the first scanning line drive circuit and the second scanning line drive circuit can be selected by the first selection circuit. Note that the transfer gates Sw1 and Sw2 are one example of the first selection circuit. Also, an output of the first selection circuit can be used to monitor the first control signal and the second control signal, and to inspect the first scanning line drive circuit and the second scanning line drive circuit.

In a specific aspect (Aspect 6) of Aspect 2, the scanning line drive circuit includes delay circuits cascaded in a plurality of stages, in which among the delay circuits cascaded in the plurality of stages, the delay circuit in a first stage is configured to be input with the start pulse and the delay circuit in the final stage is configured to output an end pulse, and in which the electro-optical device is configured to generate the first pulse based on a logical sum signal of the start pulse and the end pulse.

According to the above aspect, the sequential output circuit can use a signal generated based on the start pulse as the first pulse, even if there is an abnormality in the scanning line drive circuit.

A specific aspect (Aspect 7) of Aspect 1 includes a first signal line having one end and another end, the first signal line being configured to supply the first control signal from the one end, and a second signal line having one end and another end, the second signal line being configured to supply the second control signal, in which the first logical operation circuit is coupled to the other ends of the first signal line and the second signal line.

According to the above aspect, the logical sum signal of the first logical product signal and the second logical product signal contains a waveform reflecting the first control signal and a waveform reflecting the second control signal, in which the waveform reflecting the first control signal contains an influence due to the first signal line, and the waveform reflecting the second control signal contains an influence due to the second signal line, making it possible to monitor a waveform in a state close to when using the electro-optical device.

Note that, among the signal lines 142, the signal line 142 being supplied with the control signal Sel1 is one example of the first signal line, and the signal line 142 being supplied with the control signal Sel2 is one example of the second signal line.

A specific aspect (Aspect 8) of Aspect 1 includes a first level shifter configured to level shift a first original control signal and to output the level shifted first original control signal as a post-level shift first control signal, a first output unit configured to be input with the post-level shift first control signal and to output the post-level shift first control signal as the first control signal, a second level shifter configured to level shift a second original control signal and to output the second original control signal as a post-level shift second control signal, a second output unit configured to be input with the post-level shift second control signal and to output the post-level shift second control signal as the second control signal, a fourth logical operation circuit configured to generate a third logical product signal of the post-level shift first control signal and the first pulse, and a fourth logical product signal of the post-level shift second control signal and the second pulse, a fifth logical operation circuit configured to generate a logical sum signal of the third logical product signal and the fourth logical product signal, and a second selection circuit configured to select either one of the logical sum signal by the second logical operation circuit or the logical sum signal by the fifth logical operation circuit.

According to the above aspect, when including a configuration including the first level shifter, the second level shifter, the first output unit, and the second output unit, and the like, it is facilitated to specify portions being defective. Note that the level shifter for the control signal Sel1 supplied to the electro-optical device 10 is one example of the first level shifter, and the level shifter for the control signal Sel2 is one example of the second level shifter. Also, the buffer for the control signal Sel1 is one example of the first output unit, and the buffer for the control signal Sel2 is one example of the second output unit. The AND circuit An3_1 is one example of the third logical operation circuit, the AND circuit An3_2 is one example of the fourth logical operation circuit, and the OR circuit Or5_1 or the Or6 is one example of the fifth logical operation circuit. The transfer gates Sw1 and Sw2 are one example of the second selection circuit.

A specific aspect (Aspect 9) of Aspect 1 includes a first level shifter configured to level shift a first original control signal and to output the level shifted first original control signal as a post-level shift first control signal, a first output unit configured to be input with the post-level shift first control signal and to output the post-level shift first control signal as the first control signal, a second level shifter configured to level shift a second original control signal and to output the level shifted second original control signal as a post-level shift second control signal, a second output unit configured to be input with the post-level shift second control signal and to output the post-level shift second control signal as the second control signal, a sixth logical operation circuit configured to be input with the post-level shift first control signal and the post-level shift second control signal and to output a signal indicating whether the first level shifter and the second level shifter are normal, and a third selection circuit configured to select either one of a logical sum signal by the second logical operation circuit or a signal output from the sixth logical operation circuit.

According to the above aspect, the inspection of the first level shifter and the second level shifter and the monitoring of the first control signal and the second control signal can be selected by the third selection circuit.

Aspect 10 includes the electro-optical device according to any one of Aspects 1 to 9.

What is claimed is:

1. An electro-optical device, comprising:

a first switch provided between an input node supplied with a data signal and a first data line, the first switch being configured to be turned ON or OFF by a first control signal;

a second switch provided between the input node and a second data line, the second switch being configured to be turned ON or OFF by a second control signal;

a scanning line drive circuit including:

a first scanning line drive circuit;

a second scanning line drive circuit; and delay circuits cascaded in a plurality of stages, a start pulse being input to a delay circuit in a first stage and an end pulse being output from a delay circuit in a final stage among the delay circuits, the scanning line drive circuit being configured to sequentially delay the start pulse according to a clock signal upon driving a first scanning line and a second scanning line;

a sequential output circuit configured to output:

a first pulse based on the end pulse; and a second pulse exclusive of the first pulse, based on a signal delayed from the first pulse, according to the clock signal;

a first logical operation circuit configured to acquire a first logical product signal of the first control signal and the first pulse, and a second logical product signal of the second control signal and the second pulse;

a second logical operation circuit configured to acquire a logical sum signal of the first logical product signal and the second logical product signal; and a third logical operation circuit configured to acquire a logical sum signal of:

a first end pulse output from the first scanning line drive circuit; and a signal delayed by the sequential output circuit from a second end pulse output from the second scanning line drive circuit.

2. The electro-optical device according to claim 1, comprising a first selection circuit configured to select either one of the logical sum signal by the second logical operation circuit or the logical sum signal by the third logical operation circuit.

3. The electro-optical device according to claim 1, wherein the first pulse is generated based on a logical sum signal of the start pulse and the end pulse.

4. The electro-optical device according to claim 1, comprising a first signal line having one end and another end, the first signal line being configured to supply the first control signal from the one end; and a second signal line having one end and another end, the second signal line being configured to supply the second control signal from the one end, wherein the first logical operation circuit is coupled to the other end of the first signal line and the other end of the second signal line.

5. The electro-optical device according to claim 1, comprising:

a first level shifter configured to level shift a first original control signal and to output the level shifted first original control signal as a post-level shift first control signal;

a first output unit configured to be input with the post-level shift first control signal and to output the first control signal;

a second level shifter configured to level shift a second original control signal and to output the level shifted second original control signal as a post-level shift second control signal;

a second output unit configured to be input with the post-level shift second control signal and to output the second control signal;

a fourth logical operation circuit configured to acquire a third logical product signal of the post-level shift first control signal and the first pulse, and a fourth logical product signal of the post-level shift second control signal and the second pulse;

a fifth logical operation circuit configured to acquire a logical sum signal of the third logical product signal and the fourth logical product signal; and a second selection circuit configured to select either one of the logical sum signal by the second logical operation circuit or the logical sum signal by the fifth logical operation circuit.

6. The electro-optical device according to claim 1, comprising:

a first level shifter configured to level shift a first original control signal and to output the level shifted first original control signal as a post-level shift first control signal;

a first output unit configured to be input with the post-level shift first control signal and to output the first control signal;

a second level shifter configured to level shift a second original control signal and to output the level shifted second original control signal as a post-level shift second control signal;

a second output unit configured to be input with the post-level shift second control signal and to output the second control signal;

a sixth logical operation circuit configured to be input with the post-level shift first control signal and the post-level shift second control signal and to output a signal indicating whether the first level shifter and the second level shifter are normal; and a third selection circuit configured to select either one of a logical sum signal by the second logical operation circuit or a signal output from the sixth logical operation circuit.

7. An electronic apparatus, comprising the electro-optical device according to claim 1.

* * * * *